US012221802B2

(12) United States Patent
Perslow

(10) Patent No.: US 12,221,802 B2
(45) **Date of Patent: *Feb. 11, 2025**

(54) SYSTEMS AND METHODS FOR GENERATING WAVES

(71) Applicant: The Wave Pool Company, LLC, Huntington Beach, CA (US)

(72) Inventor: Johan Perslow, Carlsbad, CA (US)

(73) Assignee: The Wave Pool Company, LLC, Huntington Beach, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/124,233

(22) Filed: Mar. 21, 2023

(65) Prior Publication Data

US 2023/0323691 A1 Oct. 12, 2023

Related U.S. Application Data

(63) Continuation of application No. 17/482,909, filed on Sep. 23, 2021, now abandoned, which is a continuation of application No. 16/882,267, filed on May 22, 2020, now abandoned, which is a continuation of application No. 16/140,425, filed on Sep. 24, 2018, now Pat. No. 10,662,664, which is a continuation of application No. 15/876,033, filed on Jan. 19, 2018, now Pat. No. 10,119,285.

(60) Provisional application No. 62/448,926, filed on Jan. 20, 2017.

(51) Int. Cl.

| | |
|---|---|
| ***E04H 4/00*** | (2006.01) |
| ***A63B 69/00*** | (2006.01) |
| ***F04D 35/00*** | (2006.01) |

(52) U.S. Cl.
CPC ..... *E04H 4/0006* (2013.01); *A63B 69/0093* (2013.01); *F04D 35/00* (2013.01)

(58) Field of Classification Search
CPC .... E04H 4/0006; A63B 69/0093; F04D 35/00
USPC ..... 4/491
See application file for complete search history.

(56) References Cited

U.S. PATENT DOCUMENTS

| | | | |
|---|---|---|---|
| 3,473,334 | A | 10/1969 | Phillip |
| 4,142,258 | A | 3/1979 | Schiron et al. |
| 4,403,735 | A | 9/1983 | Weaver |
| 4,561,133 | A | 12/1985 | Laing |

(Continued)

FOREIGN PATENT DOCUMENTS

| | | | |
|---|---|---|---|
| DE | 10 2004 013 367 | A1 | 10/2005 |
| JP | H10137450 | A | 5/1998 |

(Continued)

*Primary Examiner* — Tuan N Nguyen
(74) *Attorney, Agent, or Firm* — K&L Gates LLP; Brian J. Novak; Benjamin D. Heuberger

(57) ABSTRACT

A wave generating system can include a water channel for creating a flow of water to produce a standing wave. A water return passageway can circulate the water back to the inlet of the water channel. One or more pipes can extend under the water channel for circulating the water. A water storage chamber can be positioned below the water channel. Water can be stored in the space between the one or more pipes, and the storage water can be isolated from the water being circulated in the system. The system can produce a hydraulic circuit with hydraulic continuity so that water can be efficiently circulated through the water channel and water return passageway. The system can be modular.

2 Claims, 19 Drawing Sheets

(56) References Cited

U.S. PATENT DOCUMENTS 4,564,190 A 1/1986 Frenzl
4,720,210 A 1/1988 Stonor et al.
4,792,260 A 12/1988 Sauerbier
4,905,987 A 3/1990 Frenzi
4,954,014 A 9/1990 Sauerbier et al.
5,044,021 A 9/1991 Murdock
5,171,101 A 12/1992 Sauerbier et al.
5,213,547 A 5/1993 Lochtefeld
5,236,280 A 8/1993 Lochtefeld
5,271,692 A 12/1993 Lochtefeld
5,342,145 A 8/1994 Cohen
5,393,169 A 2/1995 Creter
5,393,170 A 2/1995 Lochtefeld
5,401,117 A 3/1995 Lochtefeld
5,421,782 A 6/1995 Lochtefeld
5,453,054 A 9/1995 Langford
5,503,597 A 4/1996 Lochtefeld et al.
5,564,859 A 10/1996 Lochtefeld
5,628,584 A 5/1997 Lochtefeld
5,664,910 A 9/1997 Lochtefeld et al.
5,667,445 A 9/1997 Lochtefeld
5,738,590 A 4/1998 Lochtefeld
5,766,082 A 6/1998 Lochtefeld et al.
5,833,393 A * 11/1998 Carnahan ..... E04H 4/0006 4/491
5,860,766 A 1/1999 Lochtefeld et al.
5,899,633 A 5/1999 Lochtefeld
5,899,634 A 5/1999 Lochtefeld
5,911,190 A 6/1999 Lochtefeld et al.
6,019,547 A 2/2000 Hill
6,105,527 A 8/2000 Lochtefeld et al.
6,132,317 A 10/2000 Lochtefeld
6,319,137 B1 11/2001 Lochtefeld
6,336,771 B1 1/2002 Hill
6,460,201 B1 10/2002 Lochtefeld
6,491,589 B1 12/2002 Lochtefeld
6,629,803 B1 10/2003 McFarland
6,676,530 B2 1/2004 Lochtefeld
6,716,107 B2 4/2004 Lochtefeld
6,738,992 B2 5/2004 Lochtefeld
6,758,231 B1 7/2004 Lochtefeld et al.
6,928,670 B2 8/2005 Lochtefeld et al.
6,932,541 B2 8/2005 McFarland
6,957,662 B2 10/2005 Lochtefeld et al.
7,040,994 B2 5/2006 Lochtefeld et al.
7,326,001 B2 2/2008 McFarland
7,401,786 B2 7/2008 Lochtefeld
7,513,504 B2 4/2009 Lochtefeld
7,547,255 B2 6/2009 Lochtefeld
7,558,859 B2 7/2009 Kasiolas et al.
7,658,571 B2 2/2010 McFarland
7,666,104 B2 2/2010 Lochtefeld
7,722,291 B2 5/2010 McFarland
7,815,396 B2 10/2010 McFarland et al.
7,951,011 B2 5/2011 Lochtefeld
8,096,891 B2 1/2012 Lochtefeld et al.
8,262,316 B2 9/2012 Slater et al.
8,303,213 B2 11/2012 McFarland
8,366,347 B2 2/2013 Odriozola Sagastume
8,434,966 B1 5/2013 McFarland
8,496,403 B2 7/2013 Lochtefeld et al.
8,516,624 B2 * 8/2013 Klimaschewski ... A63G 31/007 4/491
8,523,484 B2 9/2013 McFarland
8,550,926 B2 10/2013 Lochtefeld
8,561,221 B2 10/2013 Lochtefeld et al.
8,573,887 B2 11/2013 Slater et al.
8,602,685 B1 12/2013 McFarland
8,622,651 B2 1/2014 McFarland
8,641,543 B2 2/2014 Lochtefeld
8,739,322 B2 * 6/2014 Hof ..... A61H 33/0087 4/507
8,882,604 B2 11/2014 Lochtefeld
9,068,371 B2 6/2015 McFarland
9,072,956 B2 7/2015 Cozens
9,103,133 B2 8/2015 McFarland
9,144,727 B2 9/2015 Lochtefeld
9,279,263 B2 3/2016 McFarland
9,328,715 B2 5/2016 Pare et al.
9,457,290 B2 10/2016 Hill
9,476,213 B2 10/2016 Slater et al.
9,506,259 B2 11/2016 Lochtefeld et al.
9,534,408 B2 1/2017 Osterman et al.
9,546,491 B2 1/2017 Slater et al.
9,550,127 B2 1/2017 Lochtefeld
9,556,633 B2 1/2017 Lochtefeld et al.
9,574,360 B2 2/2017 Fincham et al.
9,777,494 B2 10/2017 Lochtefeld et al.
9,856,665 B2 1/2018 Lochtefeld et al.
9,879,438 B2 1/2018 Lochtefeld et al.
10,119,285 B2 * 11/2018 Perslow ..... F04D 35/00
10,662,664 B2 * 5/2020 Perslow ..... E04H 4/0006
2005/0286976 A1 12/2005 Lochtefeld et al.
2008/0021776 A1 1/2008 Lochtefeld
2008/0282458 A1 * 11/2008 Carnahan ..... F04D 35/00 4/491
2008/0286047 A1 11/2008 Carnahan et al.
2008/0286048 A1 11/2008 Carnahan et al.
2009/0169305 A1 * 7/2009 Lochtefeld ..... A63G 31/007 405/79
2009/0191785 A1 7/2009 Lochtefeld
2012/0017364 A1 1/2012 Mayaud
2012/0183353 A1 7/2012 Davis et al.
2012/0201605 A1 8/2012 Hill
2012/0255112 A1 10/2012 Osterman et al.
2013/0061382 A1 3/2013 Fincham et al.
2013/0074254 A1 3/2013 Payne et al.
2014/0059768 A1 3/2014 Lemire et al.
2014/0189948 A1 7/2014 Lochtefeld et al.
2015/0033465 A1 2/2015 Lochtefeld et al.
2015/0065261 A1 3/2015 Lochtefeld
2015/0089731 A1 4/2015 Lochtefeld
2015/0330093 A1 11/2015 McFarland
2016/0053504 A1 2/2016 Lochtefeld et al.
2016/0273236 A1 9/2016 Lochtefeld et al.
2020/0284058 A1 9/2020 Perslow
2022/0259878 A1 8/2022 Perslow

FOREIGN PATENT DOCUMENTS

WO 1993/015801 A1 8/1993
WO 1993/017762 A1 9/1993
WO 1996/39235 A1 12/1996
WO 1996/41057 A1 12/1996
WO 1998/00211 A1 1/1998
WO 1998/17403 A1 4/1998
WO 1999/66131 A2 12/1999
WO 2001/08770 A1 2/2001
WO 2002/003353 A2 1/2002
WO 2002/023749 A1 3/2002
WO 2002/083256 A2 10/2002
WO 2003/051479 A2 6/2003
WO 2008/042966 A2 4/2008
WO 2008/048907 A2 4/2008
WO 2009/048441 A2 4/2009
WO 2009/064445 A1 5/2009
WO 2009/064447 A1 5/2009
WO 2009/151548 A1 12/2009
WO 2010/054850 A1 5/2010
WO 2010/059871 A1 5/2010
WO 2010/065083 A1 6/2010
WO 2012/150908 A1 11/2012
WO 2013/078443 A1 5/2013
WO 2013/116683 A1 8/2013
WO 2014/043372 A1 3/2014
WO 2014/074664 A1 5/2014
WO 2014/153456 A1 9/2014
WO 2014/190314 A2 11/2014
WO 2015/051168 A1 4/2015
WO 2016/033005 A1 3/2016
WO 2016/048948 A1 3/2016

* cited by examiner

SYSTEMS AND METHODS FOR GENERATING WAVES

CROSS-REFERENCE TO RELATED APPLICATIONS

This application is a continuation of U.S. Ser. No. 17/482,909, filed Sep. 23, 2021, which is a continuation of U.S. Ser. No. 16/882,267, filed May 22, 2020, which is a continuation of U.S. Ser. No. 16/140,425, filed Sep. 24, 2018, now U.S. Pat. No. 10,662,664, which is a continuation of U.S. Ser. No. 15/876,033, filed Jan. 19, 2018, now U.S. Pat. No. 10,119,285, which claims the benefit under 35 U.S.C. § 119 (e) of U.S. Provisional Patent Application No. 62/448,926, filed Jan. 20, 2017, and titled WAVE POOL DEVICES, SYSTEMS, AND METHODS. The entirety contents of each of the above-identified application(s) are hereby incorporated by reference herein and made part of this specification for all that they disclose.

BACKGROUND

Field of the Disclosure

Some embodiments disclosed herein relate to systems for generating waves, such as standing wave for surfing or other wave riding activities.

Description of the Related Art

Various systems for generating waves are known. Nevertheless, there remains a need for improved systems for generating waves, such as for surfing or other wave riding activities.

SUMMARY

Certain example embodiments are summarized below for illustrative purposes. The embodiments are not limited to the specific implementations recited herein. Embodiments may include several novel features, no single one of which is solely responsible for its desirable attributes or which is essential to the embodiments.

Various embodiments disclosed herein relate to systems and methods for generating a standing wave for surfing or other wave riding activities (e.g., body surfing, bodyboarding, kayak surfing, knee boarding, etc.). Certain embodiments disclosed herein (e.g., wave pool devices, systems, and methods) can provide a new design for producing manmade waves that can offer several advantages over other wave-making designs, including but not limited to the following: 1. Hydraulic continuity; 2. Internal Water Storage; 3. Modularity; 4. Small footprint; 5. Prop-engine design; 6. Rudders on nozzles; 7. Containment of water (for example in case of earthquakes).

Some embodiments disclosed herein can relate to a system for generating a standing wave for wave riding activities (e.g., surfing). The system can include a water channel, which can include an upstream portion, a downstream portion, a channel base, and side walls for containing water flowing from the upstream portion of the water channel to the downstream portion of the water channel. The water channel can be configured to generate a hydraulic jump that produces a standing wave as water flows from the upstream portion of the water channel towards the downstream portion of the water channel. A water level downstream of the hydraulic jump can be higher than a water level upstream of the hydraulic jump. The system can include a water return passageway, which can include a first end at the downstream portion of the water channel, and a second end at the upstream portion of the water channel. The water return passageway can include a plurality of pipes that extend under the water channel. The water return passageway can be configured to provide hydraulic continuity so that weight of the water downstream of the hydraulic jump provides force that urges water through the plurality of pipes to facilitate delivery of the water to the upstream portion of the water channel. The system can include a plurality of pumps configured to pump water through the plurality of pipes to compensate for energy losses due to friction and water turbulence as the water circulates through the water channel and the water return passageway and to control the speed of water flowing into the upstream portion of the water channel. The system can include a water storage chamber below the water channel. The plurality of pipes can extend through the water storage chamber. Water can be stored in the water storage chamber in space between the plurality of pipes. The water in the water storage chamber can be isolated from the water circulating through the water channel and the water return pathway. The system can include a water transfer system configured to transfer water between the water storage chamber and the water circulating through the water channel and the water return pathway (e.g., to control a water height in the water channel).

The water channel can include an inclined surface that is configured to direct water flowing in the water channel upward to facilitate generation of the hydraulic jump. The water channel can include a declined surface extending from the upstream portion of the water channel towards the downstream portion of the water channel, for example so that water entering the water channel flows down the inclined surface to increase the velocity of the flowing water. In some embodiments, at least one of the plurality of pumps can include a propeller in the water return passageway and a motor positioned in a motor holding area outside the water return passageway. A wall can separate the water return passageway from the motor holding area. A propeller shaft can be coupled to the motor and to the propeller. The propeller shaft can extend through the wall between the motor holding area and the water return passageway. The system can include one or more water diverts configured to move to alter the direction of flow of water in the water channel. At least one of the one or more pipes can comprises a plurality of fins for smoothening the water delivered by the at least one pipe.

Some embodiments disclosed herein can relate to a system for generating a standing wave for wave riding activities. The system can include a water channel having an upstream portion, a downstream portion, a channel base, and side walls for containing water flowing from the upstream portion of the channel to the downstream portion of the channel. The water channel can be configured to generate a standing wave as water flows from the upstream portion of the water channel towards the downstream portion of the water channel. The system can include a water return passageway having a first end at the downstream portion of the water channel and having a second end at the upstream portion of the water channel. The water return passageway can extend under the water channel. The water return passageway can be configured to provide hydraulic continuity from the water downstream of the standing wave in the water channel, through the first end of the water return passageway at the downstream portion of the water channel, through the water return passageway, and to the second end of the water return passageway at the upstream portion of the water channel.

In some embodiments, the system can include at least one pump configured to pump water from the first end of the water return passageway to the second end of the water return passageway. The system can include a water storage chamber, which can be below the water channel. Water stored in the water storage chamber can be isolated from the water circulating through the water channel and the water return passageway. The water return passageway can include a plurality of pipes that extend under the water channel and pass through the water storage chamber. The water stored in the water storage chamber can occupy space between the plurality of pipes. The water storage chamber can have a footprint area that is smaller than or equal to a footprint area of the water channel. The at least one pump can include a propeller in the water return passageway, a motor positioned in a motor holding area outside the water return passageway, with a wall separating the water return passageway from the motor holding area, and a propeller shaft coupled to the motor and to the propeller. The propeller shaft can extend through the wall between the motor holding area and the water return passageway. The water channel can include an inclined surface that is configured to direct water flowing in the water channel upward to facilitate generation of the standing wave. The water channel can include a declined surface extending from the upstream portion of the water channel towards the downstream portion of the water channel. Water entering the water channel can flow down the inclined surface to increase the velocity of the flowing water. The system can include one or more water diverts configured to move to alter the direction of flow of water in the water channel. The system can include one or more fins for smoothening the water output by the water return passageway.

Some embodiments disclosed herein can relate to a method of producing a standing wave for surfing. The method can include directing water into a water channel at an upstream portion of the water channel to produce a flow of water from the upstream portion of the water channel to a downstream portion of the water channel, and generating a hydraulic jump in the water channel that produces a standing wave as water flows from the upstream portion of the water channel towards the downstream portion of the water channel. A water level downstream of the hydraulic jump can be higher than a water level upstream of the hydraulic jump. The method can include propelling water through a water return passageway under the water channel to the upstream portion of the water channel. Weight of the water downstream of the hydraulic jump can provide force that urges water through the water return passageway.

The method can include operating one or more pumps to further drive the water through the water return passageway for circulating the water back to the water channel. At least one of the one or more pumps can include a propeller in the water return passageway, a motor positioned in a motor holding area outside the water return passageway, with a wall separating the water return passageway from the motor holding area, and a propeller shaft coupled to the motor and to the propeller, where the propeller shaft can extend through the wall between the motor holding area and the water return passageway. The method can include transferring water between the water channel or the water return passageway and a water storage chamber that is positioned under the water channel and isolating the water in the water storage chamber from the water in the water channel and the water return passageway. A water return passageway can include a plurality of pipes. A plurality of pumps can be configured to pump water through the respective plurality of pipes. The method can include driving the plurality of pumps differently to produce different flow rates from the plurality of pipes into the water channel. The method can include moving a water diverter to deflect water to alter the direction of water flowing in the water channel.

Some embodiments can relate to a system for generating a standing wave for wave riding activities. The system can include a water channel having an upstream portion, a downstream portion, a channel base, and side walls for containing water flowing from the upstream portion of the channel to the downstream portion of the channel. The water channel can be configured to generate a standing wave as water flows from the upstream portion of the water channel towards the downstream portion of the water channel. The system can include a water return passageway for carrying water from the downstream portion of the water channel to the upstream portion of the water channel. The water return passageway can include one or more pipes, which in some cases can extend under the water channel. The system can include a water storage chamber, which can be below the water channel. The one or more pipes can extend through the water storage chamber, for example, such that water is stored in the water storage chamber in space around the one or more pipes. The water stored in the water storage chamber can be isolated from the water circulating through the water channel and the water return passageway.

The system can include a fluid transfer system for transferring water between the water storage chamber and the water channel or water return passageway. A footprint of the water storage chamber can fits within a footprint of the water channel. The water storage chamber can have a footprint area that is smaller than or equal to a footprint area of the water channel. The water channel can have a first width and the water storage chamber can have a second width. The second width can be equal to or less than the first width. The system can be configured such that operating the system to produce a standing wave results in hydraulic continuity from an outlet of the water channel, through the water return passageway, and to an inlet of the water channel. The system can include one or more pumps, which can include a propeller in the water return passageway and a motor positioned in a motor holding area outside the water return passageway. A wall can separate the water return passageway from the motor holding area. A propeller shaft can be coupled to the motor and to the propeller. The propeller shaft can extend through the wall between the motor holding area and the water return passageway.

Some embodiments disclosed herein can relate to a system for generating a standing wave. The system can include a water channel having an upstream portion, a downstream portion, a channel base, and side walls for containing water flowing from the upstream portion of the channel to the downstream portion of the channel. The water channel can be configured to generate a standing wave as water flows from the upstream portion of the water channel towards the downstream portion of the water channel. The system can include one or more nozzles at the upstream portion of the water channel. The one or more nozzles can be configured to input a flow of water into the upstream portion of the water channel. The system can include one or more water diverters that are movable to alter the direction of the flow of water in the water channel.

Some embodiments disclosed herein can relate to a system for generating a standing wave. The system can include a water channel configured to generate a standing wave as water flows in the channel. A water return passageway can have a first end at a downstream portion of the water channel and a second end at an upstream portion of the water channel. The system can have one or more pumps configured to pump water from the first end of the water return passageway to the second end of the water return passageway. The system can have one or more nozzles at the upstream portion of the water channel. The one or more nozzles can be configured to input a flow of water into the upstream portion of the water channel. The system can have a plurality of fins in the one or more inlet nozzles, wherein the plurality of fins can be configured to smoothen the flow of water from the one or more inlet nozzles into the upstream portion of the water channel.

Some embodiments disclosed herein can relate to a system for generating a wave. The system can include a water channel configured to generate a wave as water flows in the water channel. A water return passageway can have a first end at a downstream portion of the water channel and a second end at an upstream portion of the water channel. The water return passageway can include a plurality of pipes. A plurality of nozzles, e.g., at the upstream portion of the water channel, can input a flow of water from a corresponding one of the plurality of pipes into the water channel. The system can include a plurality of pumps configured to pump water through the plurality of pipes. The plurality of pumps can be independently controllable so that a flowrate of the flow of water from each of the plurality of inlet nozzles is independent controllable. In various embodiments disclosed herein, dry motors can be used for pumping water.

BRIEF DESCRIPTION OF THE DRAWINGS

Certain embodiments will be discussed in detail with reference to the following figures, wherein like reference numerals refer to similar features throughout. These figures are provided for illustrative purposes and the embodiments are not limited to the specific implementations illustrated in the figures.

DETAILED DESCRIPTION OF CERTAIN EMBODIMENTS

Figure 1:
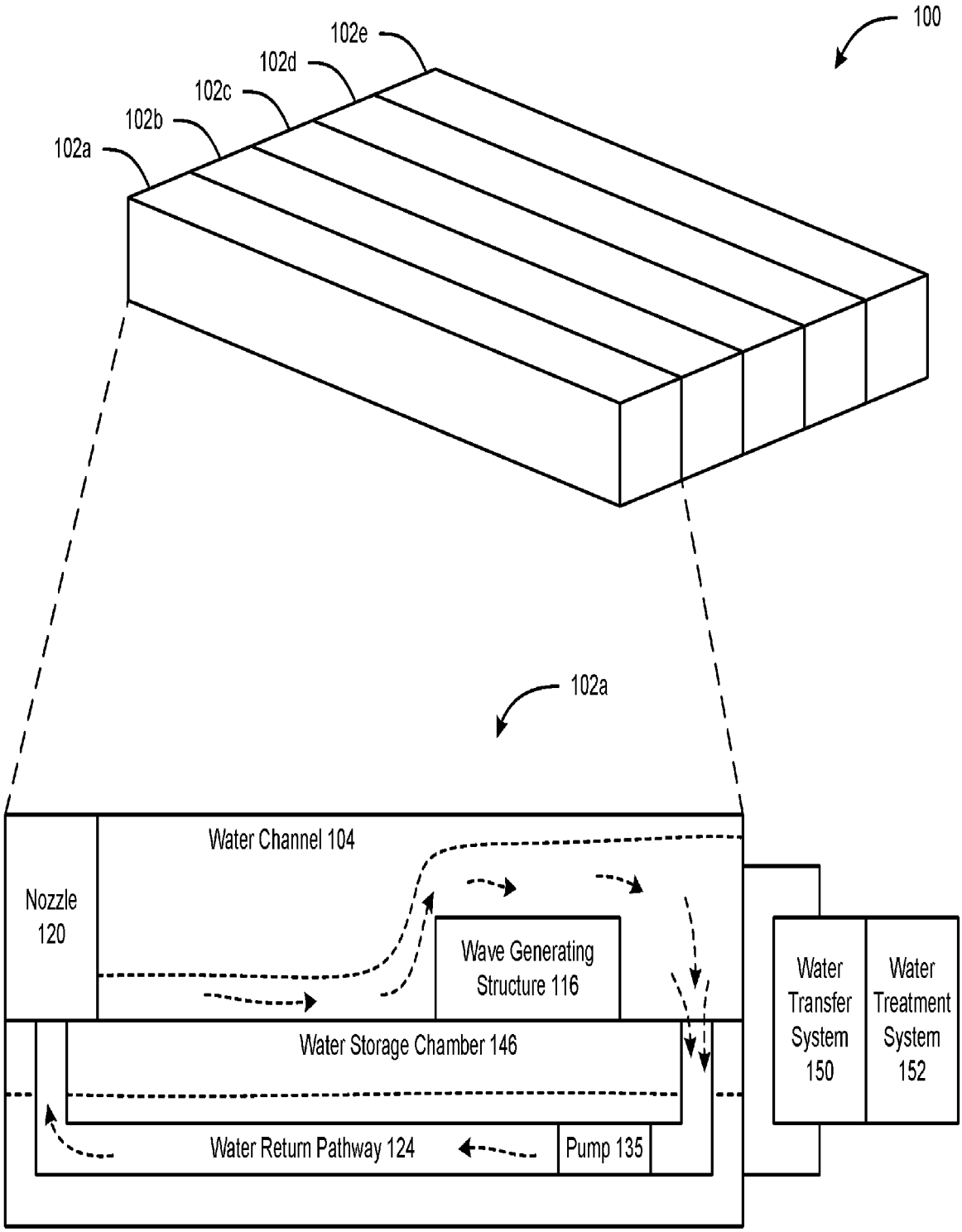
FIG. 1 schematically shows an example embodiment of a wave generating system.

Systems and methods for producing a standing wave are disclosed herein. Although many embodiments are discussed in connection with surfing, the standing waves can be used for other wave riding activities such as body surfing, bodyboarding, kayak surfing, etc. In some instances, systems for generating waves are referred to herein as wave pools, even though they can differ from traditional swimming pools and can differ from pools that produces moving waves. A wave generating system (e.g., a wave pool) can direct a flow of water through a water channel that is configured to produce a standing wave. The standing wave can have a face that is sufficiently smooth for surfing or other wave riding activities.

When viewed by poolside observers, some embodiments of the wave generating system (e.g., wave pool) can include a pool with example dimensions of approximately 60 feet long, 30 to 50 feet wide, and eight feet deep, although other systems having other sizes and dimensions can be used. Water in the pool can move from the upstream end of the pool to the downstream end of the pool, with the standing wave occurring near the middle of the pool, for example. At the upstream end of the pool, water can emerge from a series of nozzles (e.g., rectangular nozzles) near the top of the pool wall and rush down a sloped and/or curved portion of the pool floor. Near the middle of the pool the relatively shallow rushing water can encounter deeper static water and create a standing wave as it rushes up the face of the wave. On the downstream side of the wave, deeper, lower velocity flow can carry the water to the end of the pool farthest from where it entered. The rectangular pool can be surrounded by a side pool deck that can slope toward the pool, in certain embodiments, returning water that is splashed out of the pool.

In some embodiments, riders can enter the pool from the sloped pool deck adjacent the wave. Riders can drop directly onto the wave with their board underfoot, and ride the high velocity water flowing up the face of the wave. Vanes or rudders at the inlet nozzles to the pool can alter the direction of water flowing from the nozzles at the upstream end of the pool, for example creating a changing series of wave shapes. By moving the vanes and/or altering flow rate, the operator of the wave can create varied riding experiences, in certain embodiments.

In some embodiments, unseen by poolside observers can be a separate chamber beneath the visible floor of the pool. This chamber can contain one or more pipes that can be configured to carry water from the deep, downstream end of the pool to the inlet slot on the upstream end of the pool. The chamber can also provide storage for water that is moved to and from the wave pool to maintain proper water level in the wave pool. Within each pipe, a propeller can add velocity to the water flowing in the pipe, creating the continuous motion of water through the pool, into the pipe, and back to the pool again in certain embodiments. The propeller can be powered by a motor (e.g., an electric motor), for example, located in a motor room, which can be a dry equipment room, for example at the downstream end of the pool. In certain embodiments, above the motor room for example can be a water quality room housing filtration and/or disinfection equipment.

FIG. 1 schematically shows an example embodiment of a wave generating system 100. The system 100 can be modular, having a plurality of modular units 102*a-e*. FIG. 1 shows 5 modular units 102*a-e*, although any suitable number of modular units can be used (e.g., 1 unit, 2 units, 3 units, 4 units, 5 units, 6 units, 8 units, 10 units, 12 units, 15 units, 20 units, 25 units, 30 units, or more, or any value therebetween), for example depending on the desired size of the wave or surfing/riding area. In some instances, additional modular units 102*a-e* can be used to increase the width of the wave generating system 100, which can provide a larger riding area. The same modular units 102*a-e* can be used to make wave generating systems 100 of various different sizes, by including different numbers of the modular units 102*a-e*, which can simplify manufacturing and shipping of the wave generating systems 100. In an example implementation, a system with a width of about 30 feet can be made using 6 modular units, while a system with a width of about 50 feet can be made using 10 modular units.

In some embodiments, the system 100 (e.g., a wave pool) can be based on units of approximately 4 feet to 6 feet wide by 60 ft long and/or 12 ft deep (for example, 8 ft depth above the floor of the wave pool), although other sizes and dimensions can be used. This can allow embodiments of the wave pool of varied width to be constructed using the same design. For example, a small version of the system (e.g., wave pool) might include 8 units for a width of 36 ft, but a system (e.g., wave pool) of any width can be constructed, for example in increments of the width of the modular unit (e.g., 4 feet to 6 feet). Modular units of various other dimensions can be used.

In some embodiments, the modular units 102*a-e* can be partially or completed assembled individually and then joined to form the full system 100. In some cases, certain components can be shared across multiple modules, as discussed herein. For example, in some embodiments, the base of the water channel 104 can include a piece that extends across multiple modules (e.g., across the full width of the water channel). Certain components can be present in some modules, while being omitted from others, as discussed herein. For example, the side walls of the water channel 104 are included for the modules at the ends, but not for the modules in the middle of the system. Also, each modular unit 102*a-e* may or may not have its own water transfer system 150 and/or water treatment system 152. In some embodiments, a single water transfer system 150 can be used to transfer water in and out of the water storage chamber 146, and/or a single water treatment system 152 can be used for the system. In some embodiments, portions of the system 100 can be made in a non-modular manner, while certain other portions can be modular. For example, a water storage chamber 146 and/or water channel 104 can be made for the system according to the specified size, and a number of modular sets of water return pathways 124, pumps 135, nozzles 120, etc. can be incorporated into the system depending on the specified size.

Figure 2:
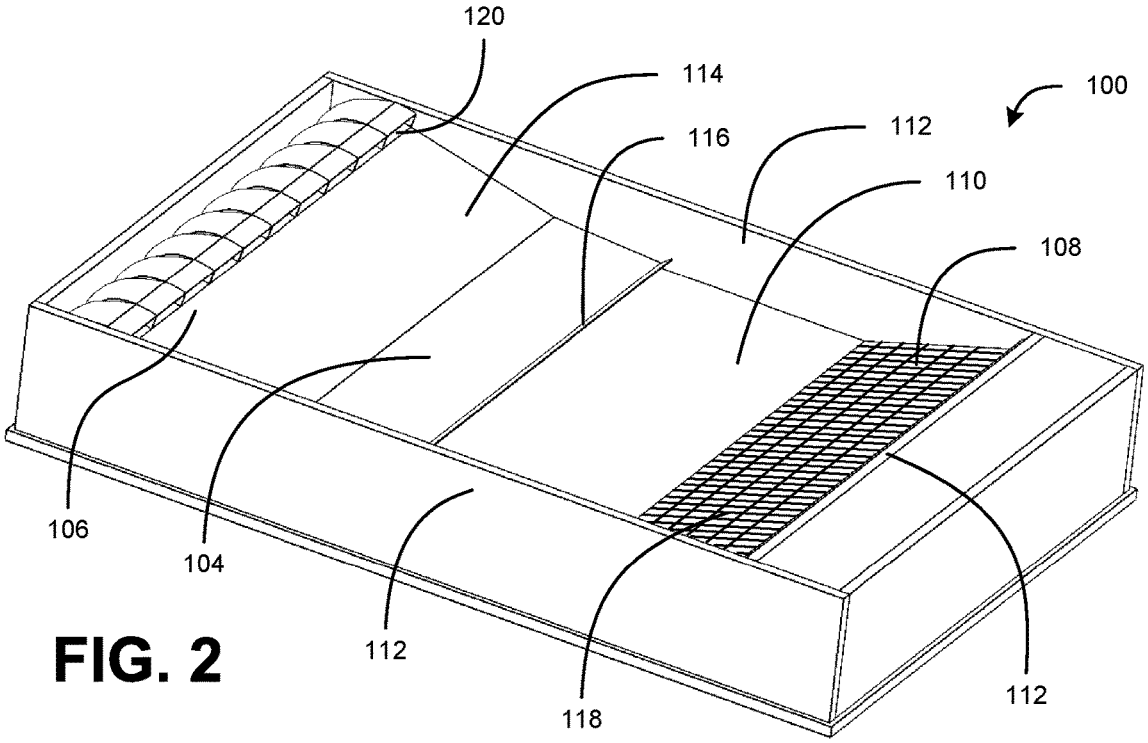
FIG. 2 is a perspective view of an example embodiment of a wave generating system.
Figure 3:
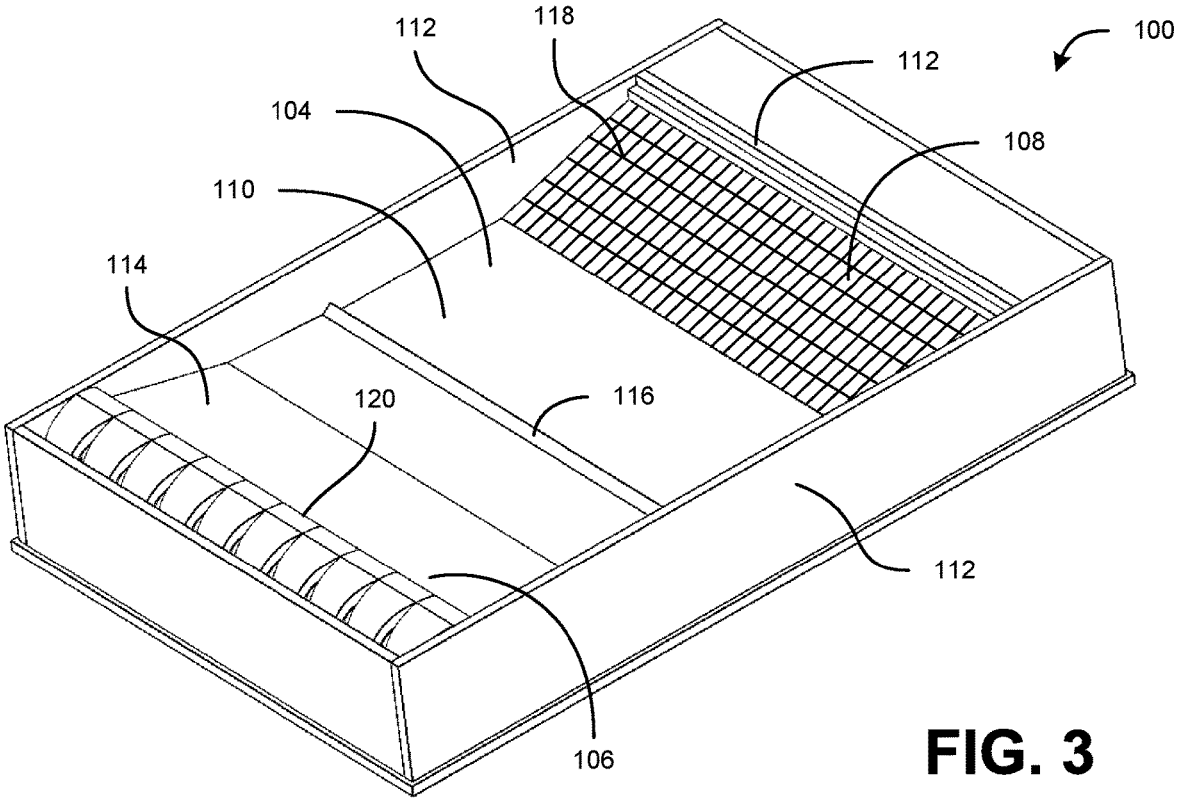
FIG. 3 is another perspective view of the example embodiment of the wave generating system in a different orientation.
Figure 4:
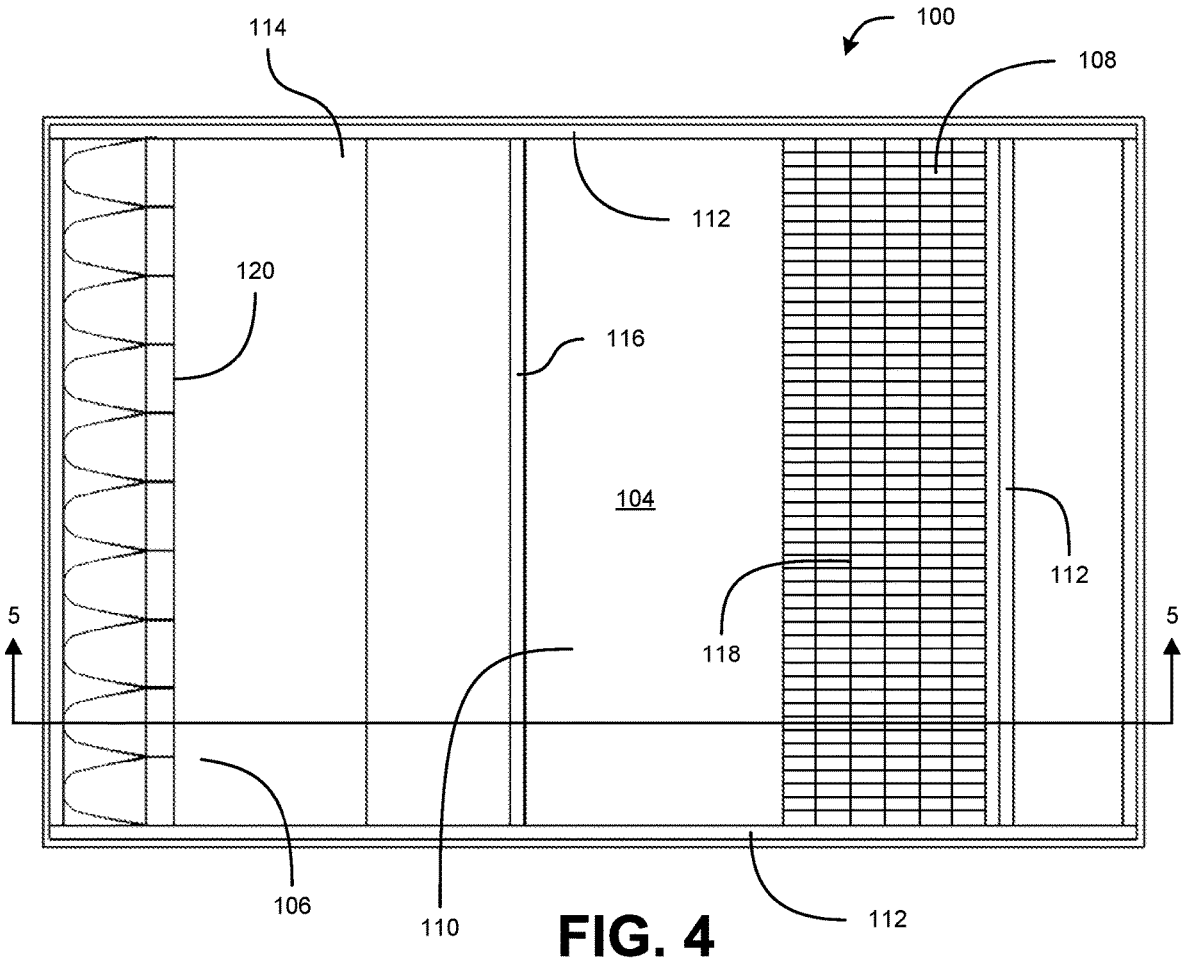
FIG. 4 is a top-down plan view of the example embodiment of the wave generating system.
Figure 5:
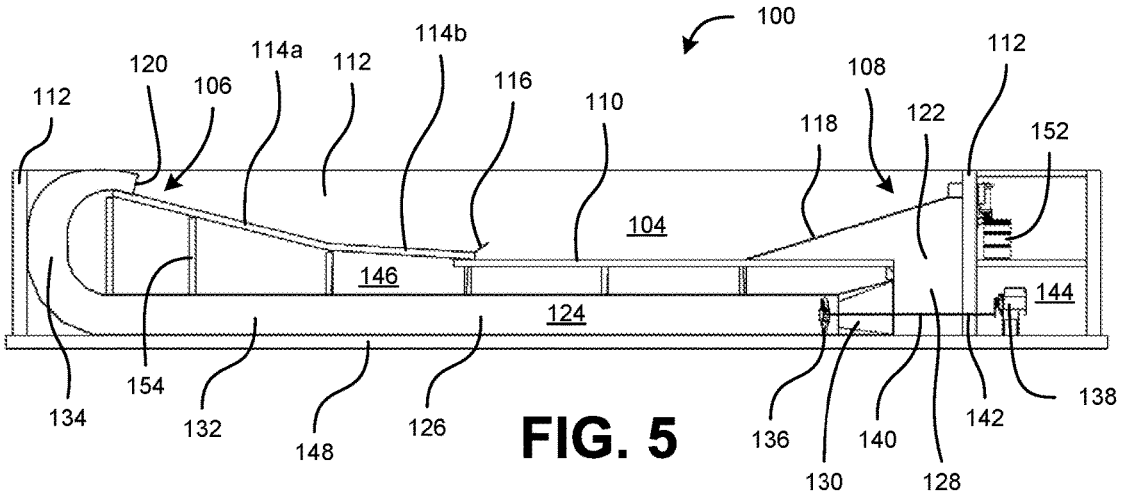
FIG. 5 is a cross-sectional side elevation view of the example embodiment of the wave generating system 100.

FIG. 2 is a perspective view of an example embodiment of a wave generating system 100. FIG. 3 is another perspective view of the example embodiment of the wave generating system 100 in a different orientation. FIG. 4 is a top-down plan view of the example embodiment of the wave generating system 100. FIG. 5 is a cross-sectional side elevation view of the example embodiment of the wave generating system 100, taken through the line 5-5 in FIG. 4. The system 100 can include a water channel 104, which can have an upstream portion 106 and a downstream portion 108. During use, water can flow from the upstream portion 106 to the downstream portion 108 of the water channel 104. It will be understood that some portions of the water can flow towards the upstream portion, such as due to turbulence in the water, but that the aggregate flow of water is in the downstream direction. The water channel 104 can be configured to produce a wave, such as a standing wave, as water flows through the water channel 104, as discussed herein. The water channel 104 can have a generally rectangular shape, when viewed from the top-down. In some embodiments, the water channel 104 can have a generally uniform width, while in other embodiments, the water channel 104 can have a width that varies along its length, such as to form a trapezoidal or other polygonal shape, when viewed from the top-down. The upstream portion 106 can be narrower than the downstream portion 108, in some implementations, for example such that water can spread out as it flows through the water channel 104, which can facilitate producing a large surfing area and/or can make it easier for the rider to exit the water channel 104. In some cases, the upstream portion 106 can be wider than the downstream portion 108, for example such that water converges as it flows through the water channel 104, which can facilitate the generation of the standing wave and/or can produce particular wave shapes. Many different shapes of water channels can be used. In some cases, the system 100 can be modular, as discussed herein. A rectangular water channel 104 can work well with the modular nature of the system 100, and can simplify manufacturing. The water channel 104 can be longer than it is wide, or it can be made wider than it is long, or having the length and width of substantially equal lengths.

The water channel 104 can have a base 110 and one or more side walls 112 for containing water flowing in the water channel 104. The side walls 112 can be vertically oriented or angled (e.g., having an angle of 0 degrees to 45 degrees from a vertical direction). Side walls 112 can extend along the right and left sides of the water channel 104. A side wall 112 can be located at the downstream portion 108 of the water channel 104. In some cases, a side wall 112 can be located at the upstream portion 106 of the water channel 104.

One or more wave generating structures can be positioned in the water channel 104 and can facilitate the production of the standing wave and/or can affect the shape of the wave as the water flows through the water channel 104. Various ramps, water diverters, protrusions, obstructions, etc, can be positioned in the water channel 104 to influence the wave. In some cases, the wave generating structure can influence one or more of the location within the channel where the standing wave is formed, the height of the standing wave, the shape of the standing wave, the smoothness of the standing wave, etc.

A declined surface 114 can be positioned at the upstream portion 106 of the water channel 104. The declined surface 114 can be positioned above the base 110 of the water channel 104. The declined surface 114 can be a ramp structure. The declined surface 114 can have an upstream end that is higher than a downstream end. Water can be introduced into the water channel 104 at or near the top of the declined surface 114, and the water can flow down the declined surface 114 towards the downstream portion 108. As the water flows down the declined surface 114, the velocity of the flowing water can increase. In some cases, as the water flows along the declined surface 114 the flow of water can become smoother, which can facilitate the producing of a standing wave that has a clean face that smooth enough for surfing, which can be somewhat similar to an unbroken face of an ocean wave. With reference to FIG. 5, a first declined surface portion 114*a* can be positioned upstream of a second declined surface portion 114*b*. The first declined surface portion 114*a* can have a steeper angle than the second declined surface portion 114*b*. The first declined surface portion 114*a* can have an angle from the horizontal direction of 5 degrees, 7 degrees, 10 degrees, 15 degrees, 20 degrees, 30 degrees, 40 degrees, or any value therebetween, or any range bounded by any combination of these values, although values outside these ranges can be used in some cases. The second declined surface portion 114*b* can have an angle from the horizontal direction of 1 degree, 2 degrees, 3 degrees, 5 degrees, 7 degrees, 10 degrees, 15 degrees, or any value therebetween, or any range bounded by any combination of these values, although values outside these ranges can be used in some cases. The declined surface 114 can be flat (e.g., not curved). For example, the first declined surface portion 114*a* can be a planar section, and the second declined surface portion 114*b* can be a planar section, oriented at a different angles. Various different types of declined surfaces can be used, as discussed herein.

An inclined surface 116 can be positioned in the water channel 104. The system can be configured to produce a standing wave in the region above the inclined surface 116, as discussed herein. The inclined surface 116 can be disposed in a central portion, along the length of the water channel 104. The inclined surface 116 can be closer to the upstream portion 106, or closer to the downstream portion 108, or positioned equidistant between the upstream portion 106 and the downstream portion 108. The inclined surface 116 can have a downstream end that is higher than an upstream end. The inclined surface 116 can be a ramp structure. Various types of inclined surfaces 116 can be used, as discussed herein.

The system 100 can include an exit structure 118, which can be configured to aid a user in exiting from the water channel 104, such as after the user has fallen or finished riding the wave. The exit structure 118 can include a grating that allows water to pass through the exit structure, and that is strong enough for a person to walk on. The grating can be inclined, such as extending from the base 100 at an upstream end to the back side wall 112 at the downstream end. When a rider falls or stops riding the wave, the rider can drift in the downstream direction along with the flow of water, and the rider can walk up the inclined grating to exit the water channel 104, such as at the downstream end. The exit structure 118 can include steps, one or more hand rails or handles, or other similar features.

Water can enter the water channel 104 at the upstream portion 106 thereof. One or more nozzles 120 can direct water into the water channel 104. The one or more nozzles 120 can operate as an inlet for water to enter the water channel 104. The example embodiment of FIGS. 2-5 includes 10 modules, which can each include a nozzle 120. The system 100 can include a single nozzle 120, or any suitable number of nozzles 120, such as depending on the width of the water channel 104. The one or more nozzles 120 can have a rectangular shape, as can be seen for example in FIG. 2. Various other nozzle shapes can be used, such as a circular shape, an elliptical shape, a polygonal shape, or any other suitable shape. In some embodiments, adjacent nozzles 120 can be positioned immediately next to each other (e.g., abutting), or near each other (e.g., within 25 cm, within 20 cm, within 15 cm, within 10 cm, within 5 cm, within 3 cm, within 2 cm, within 1 cm, or less, or any values therebetween). The water flowing from the plurality of nozzles 120 can combine into a combined flow of water. In some cases the plurality of nozzles 120 can operate similar to a single large nozzle (e.g., that spans the width of the water channel 104). In some cases, the flow of water from the plurality of nozzles 120 can be independently controlled, as discussed further herein.

Figure 6:
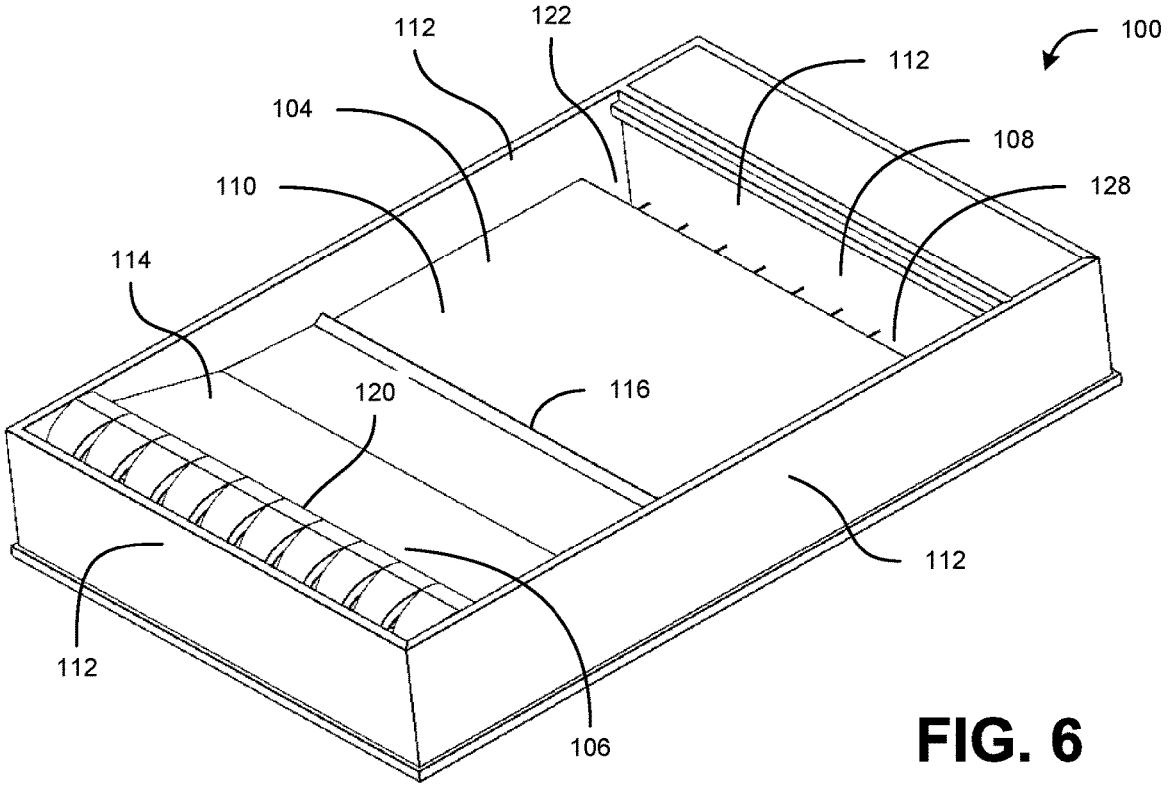
FIG. 6 is a perspective view of the example embodiment of the wave generating system having the exit structure omitted from view.

The one or more nozzles 120 and/or the declined surface 114 can produce a flow of water from the upstream portion 106 towards the downstream portion 108. An outlet 122 can be positioned at the downstream portion of the water channel 104. The outlet 122 can be disposed under the exit structure 118 (e.g., grating). The exit structure 118 can enable water to flow therethrough and to the outlet 122 so that the flowing water can exit the water channel 104, and the exit structure 118 can impede a person or object from being pulled into the outlet 122. FIG. 6 is a perspective view of the example embodiment of the wave generating system 100 having the exit structure 118 omitted from view to show the outlet 122. The outlet 122 can be one or more openings in the base 110, which can be at or near the back side wall 112. In some embodiments, the base 110 of the water channel 104 can end before reaching the back side wall 112, to define an outlet 122 for water to pass through to exit the water channel 104. In some embodiments, the outlet 122 can include a grating (e.g., separate from the exit structure) to impede objects from unintentionally passing through the outlet 122, while permitting water to pass therethrough. The grating at the outlet 122 can have openings with a width of 1 cm, 2 cm, 5 cm, 10 cm, 15 cm, or any values therebetween, or any ranges bounded by any combination of these values, although other grating sizes can be used.

Figure 7:
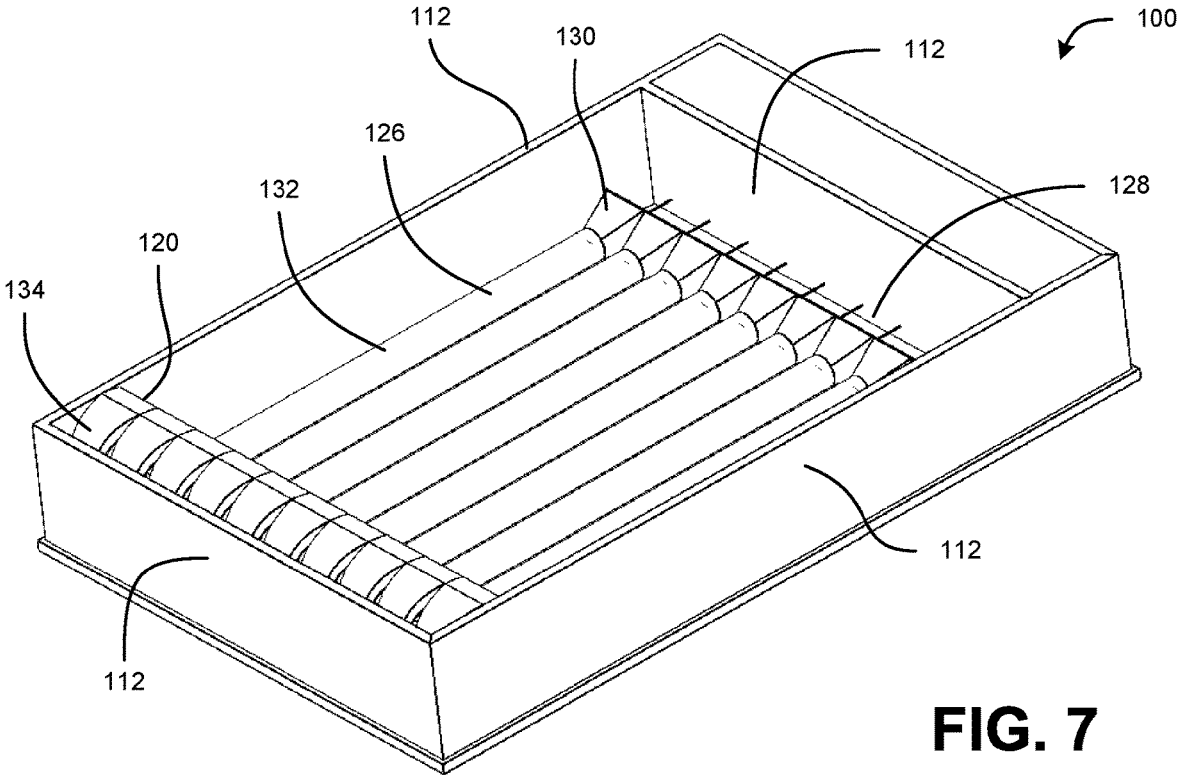
FIG. 7 is a perspective view of an example embodiment of a wave generating system with the water channel omitted from view.
Figure 8:
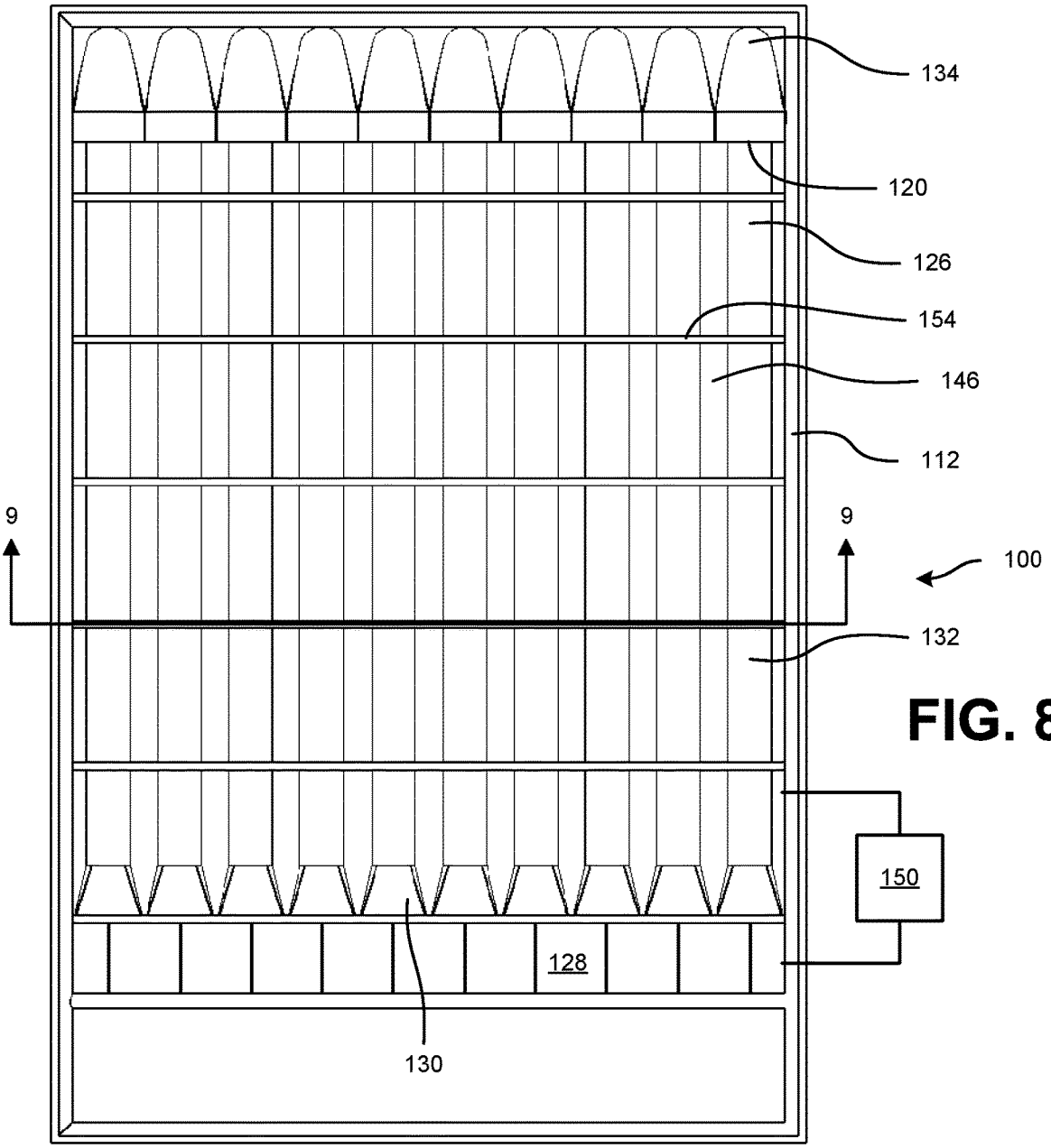
FIG. 8 is a top-down plan view of an example embodiment of a system for generating waves with the water channel omitted from view.
Figure 9:
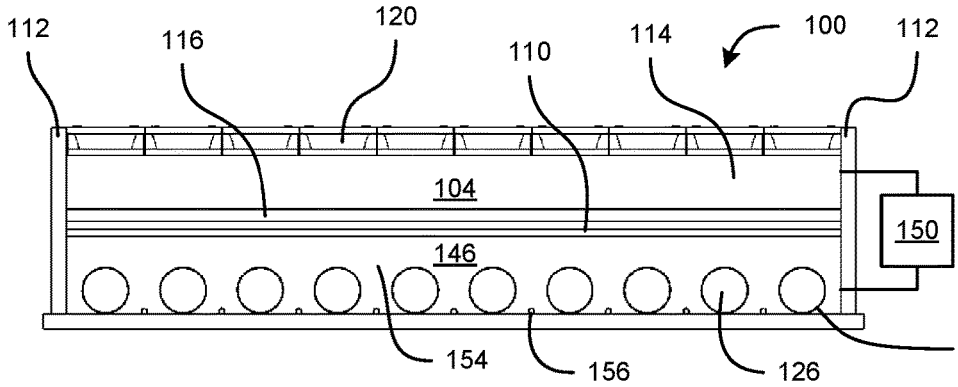
FIG. 9 is a cross-sectional view of the system, including the water channel.

The system 100 can include a water return passageway 124, which can be configured to direct water from the outlet 122 of the water channel 104 back to the inlet (e.g., one or more nozzles 120) of the water channel 104. Accordingly, water can circulate repeatedly through a water cycle, from the one or more nozzles 120 into the water channel 104, from the upstream portion 106 of the water channel 104 to the downstream portion 108 of the water channel 104, through the outlet 122 of the water channel 104 and into the water return passageway 124, and back to the one or more nozzles 120. The water return passageway 124 can extend from the outlet 122 of the water channel 104 to the inlet of the water channel 104 (e.g., the one or more nozzles 120). The water return passageway 124 can extend from the downstream portion 108 of the water channel 104 to the upstream portion 106 of the water channel 104. The water return passageway 124 can extend under the water channel 104. In some cases, some or the entire water return passageway 124 can extend around the sides of the water channel 104, which can reduce the height of the system 100. In some The water return passageway 124 can include one or more pipes 126. FIG. 7 is a perspective view of an example embodiment of a wave generating system 100 with the water channel 104 omitted from view to show the plurality of pipes 126. FIG. 8 is a top-down plan view of an example embodiment of a system for generating waves 100 with the water channel omitted from view. FIG. 9 is a cross-sectional view of the system 100, including the water channel 104) taken through line 9-9 of FIG. 8. The example embodiment of FIGS. 7-9 includes 10 modules, which can each include a pipe 126. The system 100 can include a single pipe 126 (e.g., wider than the pipes shown in FIGS. 7-9), or any suitable number of pipes 126, such as depending on the width of the water channel 104. In some embodiments, the water can pass through a basin 128 before entering the one or more pipes 126. The basin 128 can be positioned between the outlet 122 of the water channel 104 and the intake(s) of the one or more pipes 126. The basin 128 can be disposed below the outlet 122 of the water channel 104, such that water that passes downward through the outlet 122 enters the basin 128. The intake(s) for the one or more pipes 126 can be disposed below (e.g., directly below) the base 110 of the water channel 104. In some embodiments, the one or more pipes 126 do not extend out into the space (e.g., the basin 128) below the outlet 122, which can be defined by the area between the downstream end of the base 110 and the back side wall 112. The basin 128 can be a common source of water to some or all of the one or more pipes 126. For example, water can mix in the water channel 104 and/or in the basin 128. Water that was circulated through a first pipe during a first circulation can mix with other water in the water channel 104 and/or in the basin 128, and the water can be circulated through a second pipe during a second circulation, and so on.

Figure 10:
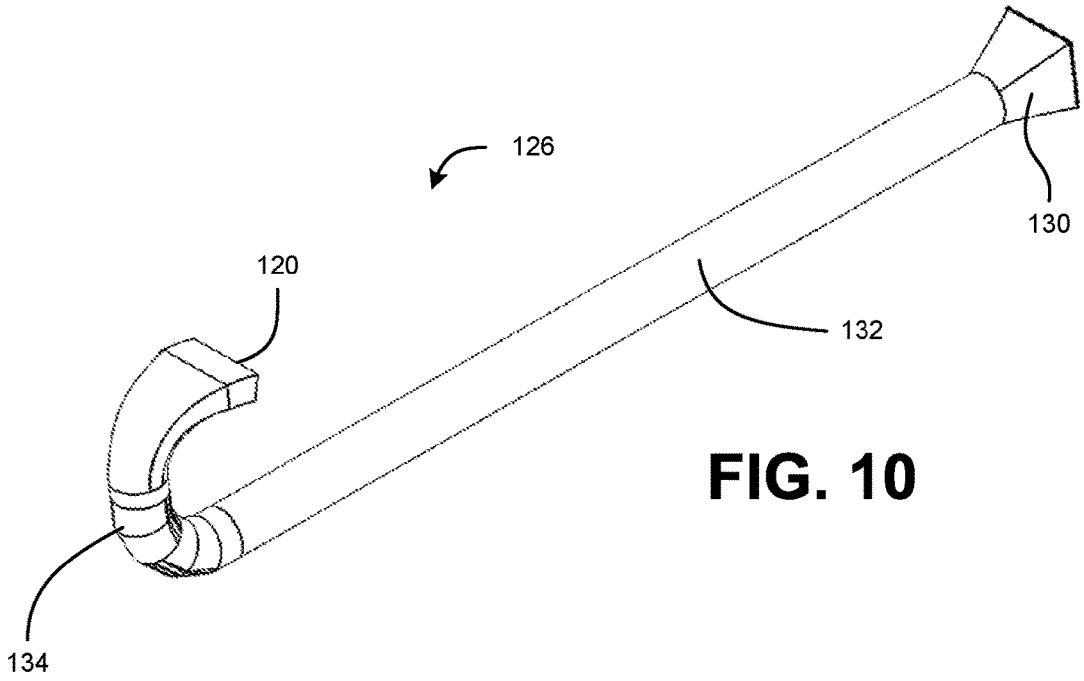
FIG. 10 is a perspective view of an example embodiment of a pipe that can be used with the system.
Figure 11:
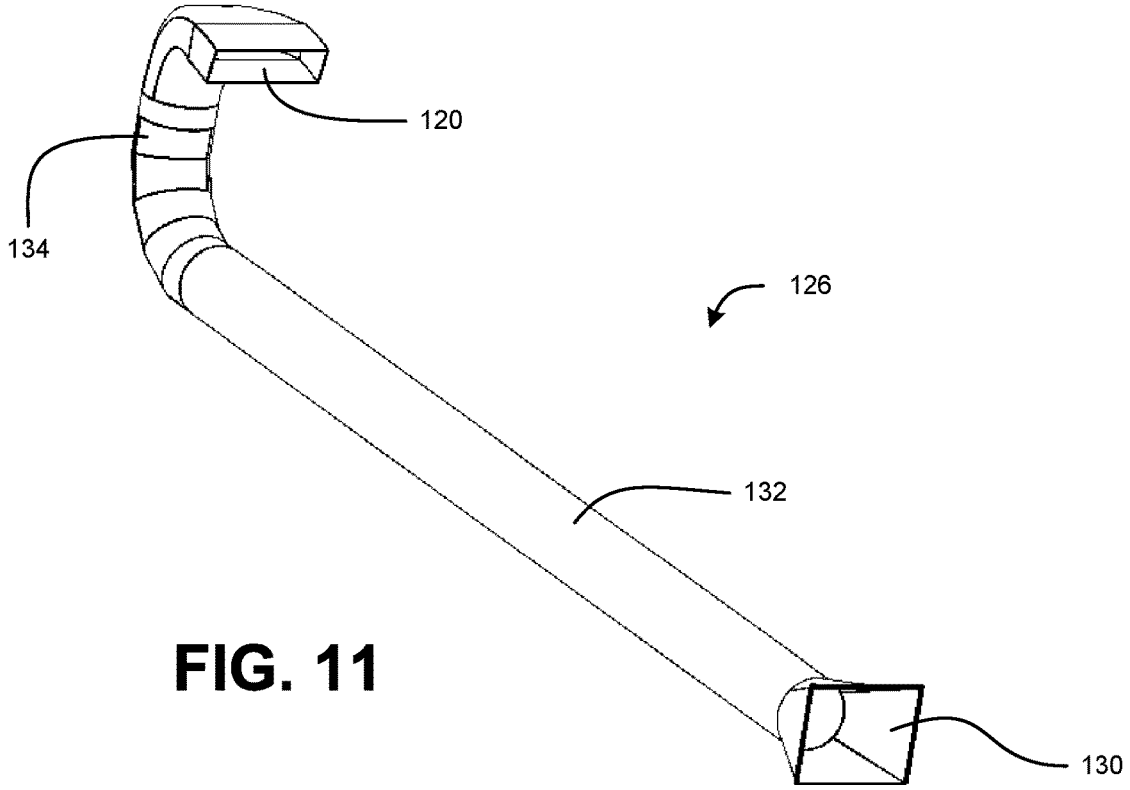
FIG. 11 is a perspective view of the example embodiment of the pipe in a different orientation.

FIG. 10 is a perspective view of an example embodiment of a pipe 126 that can be used with the system 100. FIG. 11 is a perspective view of the example embodiment of the pipe 126 in a different orientation. The pipe 126 can include an intake portion 130 at a first end of the pipe 126, a main conduit 132, and a transition portion 134, which can lead to the nozzle 120. The intake portion 130 can have an open end that can have a cross-sectional area that is larger than the cross-sectional area of the main conduit 132. The intake portion 130 can have a funnel shape, a conical shape, a frustum shape, or a pyramid shape. The open end of the intake portion 130 can have a rectangular cross-sectional shape, and in some cases the intake portion 130 can transition to a circular or elliptical cross-sectional shape (or other shape corresponding to the main conduit 132) at the junction to the main conduit 132. In some embodiments, adjacent intake portions 130 can be positioned immediately next to each other (e.g., abutting), or near each other (e.g., within 25 cm, within 20 cm, within 15 cm, within 10 cm, within 5 cm, within 3 cm, within 2 cm, within 1 cm, or less, or any values therebetween). The intake portions 130 in the aggregate can function similar to a single large water intake, in some cases, which can facilitate consistent water flow in the system 100, which can be advantageous in some cases. In some embodiments, the intake portion 130 can include a grating, which can permit water to flow into the intake portion 130 while impeding objects from unintentionally being drawn into the pipe 126. In some embodiments, the intake portion 130 can be omitted, and water can be drawn directly into the main conduit 132 of the pipe 126.

The main conduit(s) 132 of the one or more pipes 126 can extend along a generally horizontal direction. The main conduits 132 of the pipes 126 can be parallel to each other. The main conduits 132 can extend parallel to a direction extending from the downstream portion 108 of the water channel 104 to the upstream portion 106 of the water channel 104. The main conduits 132 can be positioned under the water channel 104. In some cases, from a top-down view, the footprint of the water channel 104 can cover 100%, 95%, 90%, 85%, 80%, or 75% of the main conduits 132 or of the entire pipes 126, or any values therebetween, or any ranges bounded by any combination of these values, although value outside these ranges can be used in some instances. The main conduit 132 can have a consistent cross-sectional area and/or shape across the length of the main conduit 132. The cross-sectional shape of the main conduit 132 can be a circle, although other cross-sectional shapes can be used, such as an ellipse, a rectangle, or other polygon shape. The main conduit 132 can provide a substantially linear flow of water therein. The main conduits 132 of adjacent pipes 126 can be spaced apart from each other, such as by 10 cm, 15 cm, 20 cm, 25 cm, 30 cm, 35 cm, 40 cm, 50 cm, 60 cm, 75 cm, 100 cm, or any values therebetween, or any ranges bounded by any combination of these values, although values outside these ranges could be used in some implementations. As discussed herein, the space between and/or around the one or more pipes 126 can be used to store water that is not being circulated through the water channel 104 and water return passageway 124. The intake portions 130 that are larger than the corresponding main conduits 132 can enable the main conduits 132 to be spaced apart (e.g., to provide water storage space) while also providing a large area for receiving water into the pipes 126. The intake ends of adjacent pipes 126 (e.g., the intake portions 130) can be sealed so that water does not flow between the basin 128 to the space between the pipes 126.

The transition portion(s) 134 of the one or more pipes 126 can redirect the water that was flowing in a direction parallel to the upstream direction of the water channel 104 so that the water can flow into the water channel 104 in the downstream direction. The transition portion 134 can include conduit that makes a turn of 90 degree, 105 degrees, 120 degrees, 135 degrees, 150 degrees, 165 degrees, 180 degrees, 195 degrees, 210 degrees, 225 degrees, 240 degrees, or any values therebetween, or any ranges bounded by any combination of these values, although other values can be used in some implementations. The transition portion 134 can turn more than 180 degrees and can direct the water in a downstream direction and/or in a downwardly angled direction, which can correspond to the downward angle of the declined surface 114 at the nozzle 120. The transition portion 134 can receive water flowing a first direction (e.g., generally towards an upstream portion of the water channel 104) and can output water flowing in a second direction that is different than the first direction (e.g., generally towards a downstream portion of the water channel 104). The second direction can be generally opposite of the first direction.

The transition portion 134 can have a cross-sectional shape that changes across the length of the transition portion 134. The cross-sectional shape of the transition portion 134 at the junction to the main conduit 123 can correspond to the cross-sectional shape of the main conduit 123 (e.g., a circular cross-sectional shape in the example of FIGS. 7-11). The cross-sectional shape of the transition portion 134 at the junction to the nozzle 120 can correspond to the cross-sectional shape of the nozzle 120 (e.g., a rectangular cross-sectional shape in the example of FIGS. 7-11). Other cross-sectional shapes can be used, as discussed herein. In some cases, the transition portion 124 can have a substantially constant cross-sectional area as the cross-sectional shape changes across the length of the transition portion 134. In some embodiments, the cross-sectional area can decrease along the length of the transition portion 134 towards the nozzle 120, which can increase the velocity of water exiting the pipe 126 (e.g., via the nozzle 120). In some embodiments, the cross-sectional area can increase along the length of the transition portion 134 towards the nozzle 120.

The nozzle 120 can have a width that is substantially the same as the intake end of the pipe 126, although in some embodiments the width of the nozzle 120 can be larger or smaller than the width of the intake end of the pipe 126. In some embodiments, the area of the intake end of the pipe 126 can be larger than the area of the corresponding nozzle 120, which can increase the velocity of the water exiting the nozzle 120. The area of the intake end of the pipe 126 can be larger than the area of the corresponding nozzle 120 by 10%, 25%, 50%, 75%, 100%, 125%, 150%, 175%, 200%, or any values therebetween, or any ranges bounded by any combination of these values, although values outside these ranges can be used in some cases. Alternatively, the area of the nozzle 120 can be the same as or smaller than the area of the intake end of the pipe 126. The end of the pipe 126 can have a substantially constant size, a substantially constant cross-sectional shape, and/or a substantially constant direction for a length before the exit of the nozzle 120, which can facilitate smoothening of the water and/or can give the water exiting the nozzle 120 a generally linear flow direction. The length can be 0.2 m, 0.3 m, 0.4 m, 0.5 m, 0.6 m, 0.7 m, 0.8 m, 0.9 m, 1 m, 1.2 m, 1.5 m, 2 m, 3 m, or more, or any values therebetween, or any ranges bounded by any combination of these values, although other values can be used in some instances.

The system 100 can include one or more pumps for propelling water through the water return passageway 124. In some embodiments, a pump can be provided for each pipe 126. For example, the example system 100 can have 10 modules, each including a pump. The pump can propel water through the pipe 126 to circulate the water back to the inlet of the water channel 104. As discussed herein, the system 100 can be designed such that the weight of the water in the water channel 104 can provide force that propels water through the one or more pipes 126. Accordingly, the one or more pumps can be used to compensate for losses of energy, such as due to turbulence in the water, friction of the water flowing in the one or more pipes, and/or turbulence of the water flowing the water channel 104, etc. The one or more pumps can be used to maintain the circulation of water that is also being driven by the continuous hydraulic circuit, as discussed herein. Accordingly, the system 100 can use less powerful pumps and can consume less energy, as compared to other systems that use large, powerful, and expensive pumps to move water to or from an open air body of water (e.g., a reservoir). The one or more pumps can be used to adjust the flow rate, the velocity of water in the water channel 104, etc. The one or more pumps can be used to adjust the size and/or shape of the generated wave, as discussed herein.

In some embodiments, the system 100 can use a prop-engine design for pumping water. Some embodiments of the system 100 (e.g., a wave pool) can use propellers powered by motors (e.g., electric motors) to add energy to the water and create the velocity needed to operate the system (e.g., a wave pool). The motors (e.g., electric motors) can be located in the motor room, for example a dry equipment room, facilitating maintenance and/or reducing the cost and weight of equipment compared to the large, expensive, heavy pumps in other manmade wave designs.

Figure 12:
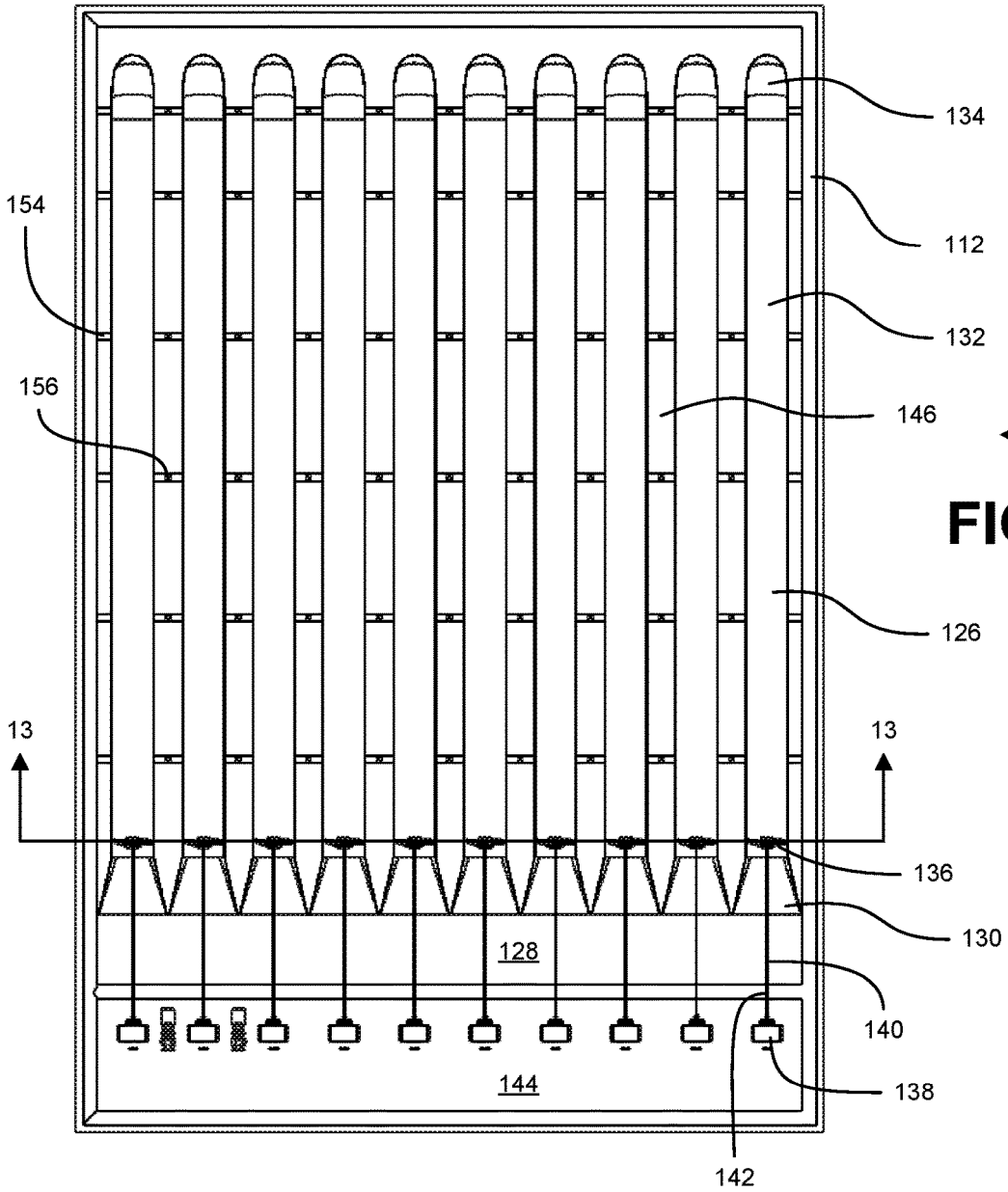
FIG. 12 is a cross-sectional top-down plan view taken through a series of pumps in an example embodiment of a wave generating system.
Figure 13:
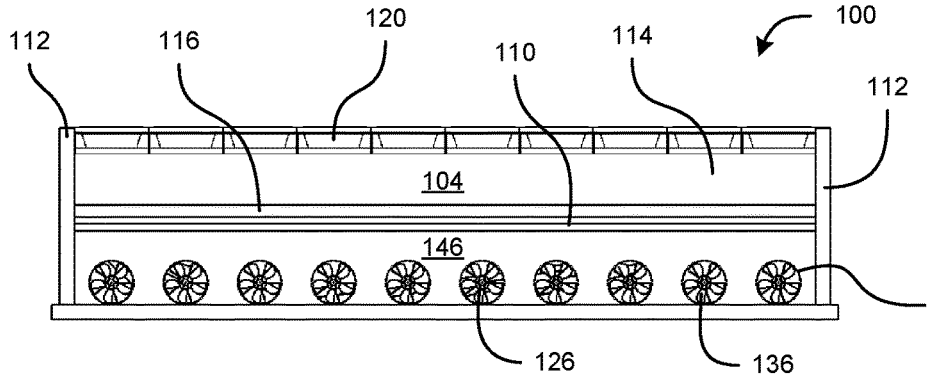
FIG. 13 is a cross-sectional side view taken through the propellers.

FIG. 5 is a cross-sectional side view taken through a pump. FIG. 12 is a cross-sectional top-down plan view taken through a series of pumps in an example embodiment of a wave generating system 100. FIG. 13 is a cross-sectional side view taken through the propellers at line 13-13 in FIG. 12. The pump can include a propeller 136, which can be driven by a motor 138. A shaft 140 can couple the propeller 136 to the motor 138. The motor 138 can turn the shaft 140, which can then turn the propeller 136 to drive water through the pipe 126. The propeller 136 can be disposed inside a pipe 126, such that turning the propeller 136 drives water through the pipe 126. The propeller 136 can be positioned at or near the intake portion 130 of the pipe 126 or the junction between the intake portion 130 and the main conduit 132. The propeller 136 can be positioned within 0.1 m, 0.2 m, 0.3 m, 0.5 m, 0.7 m, 1 m, 1.5 m, 2 m, of the intake end of the pipe 126, or any values therebetween, or any ranges bounded by any combination of these values, although other positions can be used in some cases. The propeller 136 can be positioned below a downstream portion 108 of the water channel 104. The shaft 140 can be aligned with a center axis that extends along the pipe 126 (e.g., along the main conduit 132). The shaft 140 can extend through the basin 128.

The motor 138 can be positioned in a motor holding area 144 that can be isolated from the water circulating in the system 100. The motor holding area 144 can be a dry compartment or room. A wall (e.g., back side wall 112) can separate the motor holding area 144 from the area containing water (e.g., from the basin 128). The shaft 140 can extend through the wall. The wall can include a shaft seal 142, which can be configured to permit the shaft 140 to spin while impeding leaking of water into the motor holding area 144.

The motor holding area 144 can be accessible, such as via a door, access panel, crawl space, etc. The motor(s) 138 can be accessed for servicing, replacement, etc. without draining the water. The system 100 can include a pump for each pipe 126. The flow rate and/or water velocity for the different pipes 126 can be independently controlled, which can be used for example, to control the wave in the wave channel 104, as discussed herein. In some cases, other types of suitable pumps can be used.

The system 100 can use one or more dry motors 138, which can be located in the dry motor holding area 144. The try motors 138 can be advantageous compared to wet motors that are submerged in the water and used for pumping in other wave generating systems. Because the dry motor 138 is isolated from the water, the risk of electric shock can be reduced. Also, higher voltages and/or more electrical power can be used for the dry motors 138, as compared to wet motors. For example, the one or more motors 138 can use 100 volts, 110 volts, 120 volts, 150 volts, 200 volts, 220 volts, 277 volts, 300 volts, 350 volts, 400 volts, 450 volts, 480 volts, 500 volts, or more, or any values therebetween, or any ranged bounded therein.

In some cases gearing can be used between the motor 128 and the propeller 136 and/or shaft 140. For example, belts, pulleys, gears, or any other suitable mechanical drivetrain can be used to provide different rotation rates between the motor 138 and the propeller 136 and/or the shaft 140. The gearing can cause the propeller 136 to rotate at a slower rate than the motor 138. The propeller 136 can rotate at a speed that is 100% (e.g., a direct drive system with no gearing), 90%, 80%, 70%, 60%, 50%, 40%, 33%, 30%, 25%, 20%, 15%, or 10% of the motor speed, or any values therebetween, or any ranges bounded therein, although other relative speeds can be used in some cases. For example, the gearing can produce a 3 to 1 stepdown in the rotational speed, such that the motor 138 can spin at 1800 rpm (e.g., using a 4 pole motor) to cause the propeller 136 to spin at 600 rpm.

In some instances a wet motor is a direct drive system that does not use gearing because the wet motor is in the water. To produce the appropriate rotational speed for the pump, the wet motor can be a 6 pole motor, an 8 pole motor, or larger, which can increase the weight, cost, and complexity. In some instances, wave generating systems can use wet motors that weight 5000 pounds or more for pumping water. In some embodiments, the systems disclosed herein can use 2 pole motors or 4 pole motors. The dry motors 138 discussed herein can weigh 200 pounds, 300 pounds, 400 pounds, 500 pounds, 600 pounds, 700 pounds, 800 pounds, 900 pounds, 1000 pounds, or any values therebetween, or any ranges bounded therein, although other sizes of motors could also be used. Also, lighter motors can be used because the system and use hydraulic forces to assist with circulating water, as discussed herein. In some cases a variable speed motor 138 can be used. For example, the speed of the propeller 136 can be varied between 0 rpm, 100 rpm, 200 rpm, 300 rpm, 400 rpm, 500 rpm, 600 rpm, 700 rpm, 750 rpm, 800 rpm, 900 rpm, 1000 rpm, or any values therebetween, or any ranged bounded therein, although other speeds are possible.

The system 100 can include a water storage chamber 146. Some embodiments of the system (e.g., a wave pool) can incorporate a storage space below the pool floor (e.g., for water storage), which can eliminate the need for exterior storage (e.g., exterior water storage) and/or can reduce the space needed to construct the facility, for example. For example, below the floor where the wave occurs (e.g., below the base 110 of the water channel 104) can be a chamber 146 that holds the conveyance pipe(s) 126 and/or extra space for water storage (e.g., in the space surrounding the conveyance pipe(s) 126). As flow rates through the wave are varied, the amount of water needed in the upper pool can vary. The water stored below the pool floor can be pumped up or drained down as needed, in some embodiments. In some embodiments, the presence of an open air surface in the water storage chamber 146 can result in much lower hydrostatic pressure on the lower portion of the containment pool than would otherwise be experienced (e.g., with a single 12 ft deep pool of water), reducing the potential for leaks.

One significant advantage of some embodiments of the systems disclosed herein (e.g., wave pool systems) compared to other manmade wave generating systems (e.g., wave pools) can be the compact footprint of systems (e.g., wave pools) disclosed herein. In some implementations, aside from the equipment housing (e.g., the motor holding area 144 and/or water treatment system area) at the downstream end of the system (e.g., wave pool) and optionally sloping pool decks adjacent the sides of system (e.g., wave pool), there can be no external pools, storage areas, and/or other features of the system (e.g., pool). The use of electric motors and/or propellers in certain embodiments, as described herein, can also reduce the footprint of certain embodiments of the system (e.g., wave pool) by minimizing the need for large access entrances and/or heavy cranes for removal and service of pumps.

Some features can relate to the containment of water in the system. Some embodiments of the system (e.g., wave pool) can be designed so that all or substantially all of the water and/or equipment is contained within a single, compact, coherent structure. This can be in contrast to other designs which can include external pipes, tanks, and/or pools. Certain embodiments of the system (e.g., wave pool) design can allow a simple, strong concrete structure to contain all or substantially all of the water and/or equipment, resulting in a facility that can be more resistant to earthquakes, settling, or other disturbance compared to other manmade wave facilities.

The water storage chamber 146 can be positioned below the water channel 104. The water storage chamber 146 can be contained between the base 110 of the water channel 104 on the top and a floor 148 on the bottom. Side walls can contain the water in the water storage chamber 146. In some embodiments, the side walls 112 of the water channel 104 can extend downward below the water channel 104 so that the side walls 112 contain the storage water in the water storage chamber 146. In some embodiments, the water storage chamber 146 does not extend to the back side wall 112. Rather, the water storage chamber 146 can end before the intake ends of the one or more pipes 126. The basin 128 (e.g., circulating water) can be positioned between the water storage chamber 146 and the back side wall 112. In some cases, the intake portions 130 of the pipes 126 can be sealed to define a back end of the water storage chamber 146. In some cases a chamber back wall (e.g., positioned under the water channel 104) can define the back end of the water storage chamber 146.

The one or more pipes 126 can extend through the water storage chamber 146. The storage water can be stored in the space in between and/or around the one or more pipes 126. The water in the water storage chamber 146 can be isolated from the water in the pipes 126, such that water does not flow between the pipes 126 and the water storage area 146. The water that circulates in the system 100, such as in the water channel 104 and the water return passageway 124, can be isolated from the water in the water storage chamber 146. The storage water in the chamber 146 can remain relatively still and undisturbed as the circulation water is circulated through the water channel 104 and the water return passageway 124. In some embodiments, the one or more pipes 126 can be elevated above the floor 148, at least at some locations, so that water can spread through the water storage chamber 146 (e.g., when the water level is below the height of the pipes 126). In some embodiments, channels in the floor 148 can permit water to flow under the one or more pipes 126 so that water can be distributed throughout the water storage chamber 146. In some embodiments, the water storage chamber 146 can be sealed from atmosphere. The water storage chamber 146 can be sealed off from the ambient area around the system 100. Dust or other contaminates can be impeded from entering the water storage chamber 146.

In some implementations, water can be moved out of the water channel 104 and into the water storage chamber 146, so that the water channel 104 is substantially empty. This can facilitate making repairs or modifications to the water channel 104. The volume of the water storage chamber 146 and the water return passageway 124 (e.g., the one or more pipes 126) can be large enough to hold the full volume of water for the system 100. In some cases, the water can be moved out of the water storage chamber 146 and into the water channel 104, so that the water storage chamber 146 is substantially empty. This can facilitate making repairs or modifications in the water storage chamber 146. Water can remain in the water return passageway 124 (e.g., the one or more pipes 126) when the water storage area is drained. The volume of the water channel 104 (and the water return passageway 124 in some embodiments) can be large enough to hold the full volume of water for the system 100. In some cases the supports 154 can have one or more openings 156 that are sufficiently large for a person to pass through (e.g., see FIG. 42), such as for making repairs or modifications inside the water storage chamber 146. The openings 156 can have a width of 0.5 m, 0.75 m, 1 m, 1.25 m, 1.5 m, 1.75 m, 2 m, or any values therebetween, or any ranges bounded therein, although other sizes can be used.

The weight of the water in the water channel 104 can be supported by the base 110 of the water channel 104. The weight of the water in the water storage chamber 146 can be supported by the floor 148. Distributing the weight of the water between different surfaces can improve the durability of the system and can simplify manufacturing of the system. The water storage chamber 146 can have air above the water that is stored in the water storage chamber 146. The depth of water in the water storage chamber 146, and the water pressure produced by the depth of water, can be independent of the water in the water channel 104. Water in the water channel 104 can provide force that pushes water through the one or more pipes 126, as discussed herein, but the water in the water storage chamber 146 can be isolated from that force. In some embodiments, the water pressure of the storage water depends on the depth of water in the water storage chamber 146 and not on the depth of water in the water channel 104, the basin 128, the one or more pipes 126, etc.

In some embodiments, the water storage chamber 146 can have a footprint, from a top-down view, that is equal to or smaller than the footprint of the water channel 104. The size of the area of the footprint of the water storage chamber 146 can be 50%, 55%, 60%, 65%, 70%, 75%, 80%, 85%, 90%, 95%, 100%, 105%, 110%, 115%, 120%, or 125% of the size of the area of the footprint of the water channel 104, or any values therebetween, or any ranges bounded by any combination of these values, although other values could be used in some cases. Some of or the entire water storage chamber 146 can be directly below the water channel 104. The entire footprint of the water storage chamber 146 can be positioned entirely within the footprint of the water channel 104. In some embodiments, at least a percentage of the footprint of the water storage chamber 146 can be positioned within the footprint of the water channel 104, and the percentage can be 100%, 95%, 90%, 85%, 80%, 75%, 70%, 65%, 60%, 55%, or 50%, or any values therebetween, or any ranges bounded by any combination of these values, although other values could also be used in some implementations. In some cases, the water channel 104 can be defined by the area bounded by the right side wall, the left side wall, back side wall (e.g., at the downstream portion 108), and the front side wall (e.g., at the upstream portion 106). The same right side wall, left side wall, and front side wall, can define the water storage chamber 146. In some cases, the water storage chamber 146 does not extend to the back side wall (e.g., due to the basin 128). In some cases, the water channel 104 can be defined based at least in part on the location where the water flows out of the one or more nozzles 120. In some cases, the water storage chamber 146 can extend to the area between and/or around the transition portions 134 of the one or more pipes 126, which can be past the location of the one or more nozzles 120 in the upstream direction. Accordingly, in some cases, a portion of the water storage chamber 146 can extend to an area that is outside the footprint of the water channel 104 (e.g., if defined using the locations where water flows out of the nozzles).

A water transfer system 150 can be used to move water between the water storage chamber 146 and the water circulation portion of the system. An example water transfer system 150 is shown schematically in FIG. 8. The water transfer system 150 can have a first fluid line (e.g., a pipe, tube, or other conduit) that is coupled to the water storage chamber 146, and a second fluid line that is coupled to the basin 128. The second fluid line can be coupled to any suitable a location that is part of the water circulation (e.g., the water channel 104 and the water return passageway 124). The water transfer system 150 can include one or more pumps for driving water for the transfer. The water transfer system 150 can have one or more valves, which can be electronically controller or manually controlled. The one or more valves can have a first configuration that is configured to impede flow of water (e.g., to isolate the water storage chamber 146 from the water in the circulation portion of the system 100). The one or more valves can have a second configuration that is configured to permit flow of water between the water storage chamber 146 and the water circulation portion (e.g., to the basin 128). In some cases, the one or more valves can selectively direct water out of the water storage chamber 146, such as to increase the level of water in the water channel 104, or into the water storage chamber 146, such as to reduce the level of water in the water channel 104. In some embodiments, the one or more pumps of the water transfer system can be driven in a first mode to move water into the water storage chamber 146 and in a second mode to move water out of the water storage chamber 146. The water transfer system 150 can transfer water between one or more suitable locations of the water storage chamber 146 and one or more suitable locations associated with the water circulation in the system 100. In FIG. 8, the water transfer system 150 can transfer water generally horizontally between the water storage chamber 146 and the basin 128. In FIG. 9, the water transfer system 150 can transfer water generally vertically between the water storage chamber 146 and the water channel 104.

The system 100 can include a water treatment system 152, as can be seen in FIG. 5, such as for cleaning the water, filtering the water, disinfecting the water (e.g., using chlorine, ozone, or any other suitable disinfectant), etc. The water treatment system 152 can be positioned in an area (e.g., a dry room or compartment), which can be above the motor holding area 144. In some embodiments, the water treatment system 152 can be positioned together with the one or more motors in the same area, room, or compartment (e.g., in the motor storage area). Water can be delivered to the water treatment system 152 for treatment, and treated water can be returned. The water treatment system 152 can receive water from either or both of the water storage chamber 146 and/or the water circulation portion (e.g., the water channel 104 and/or the water return passageway 124). In some cases, the water transfer system 150 can be configured to deliver water to and/or from the water treatment system 152.

Figure 14:
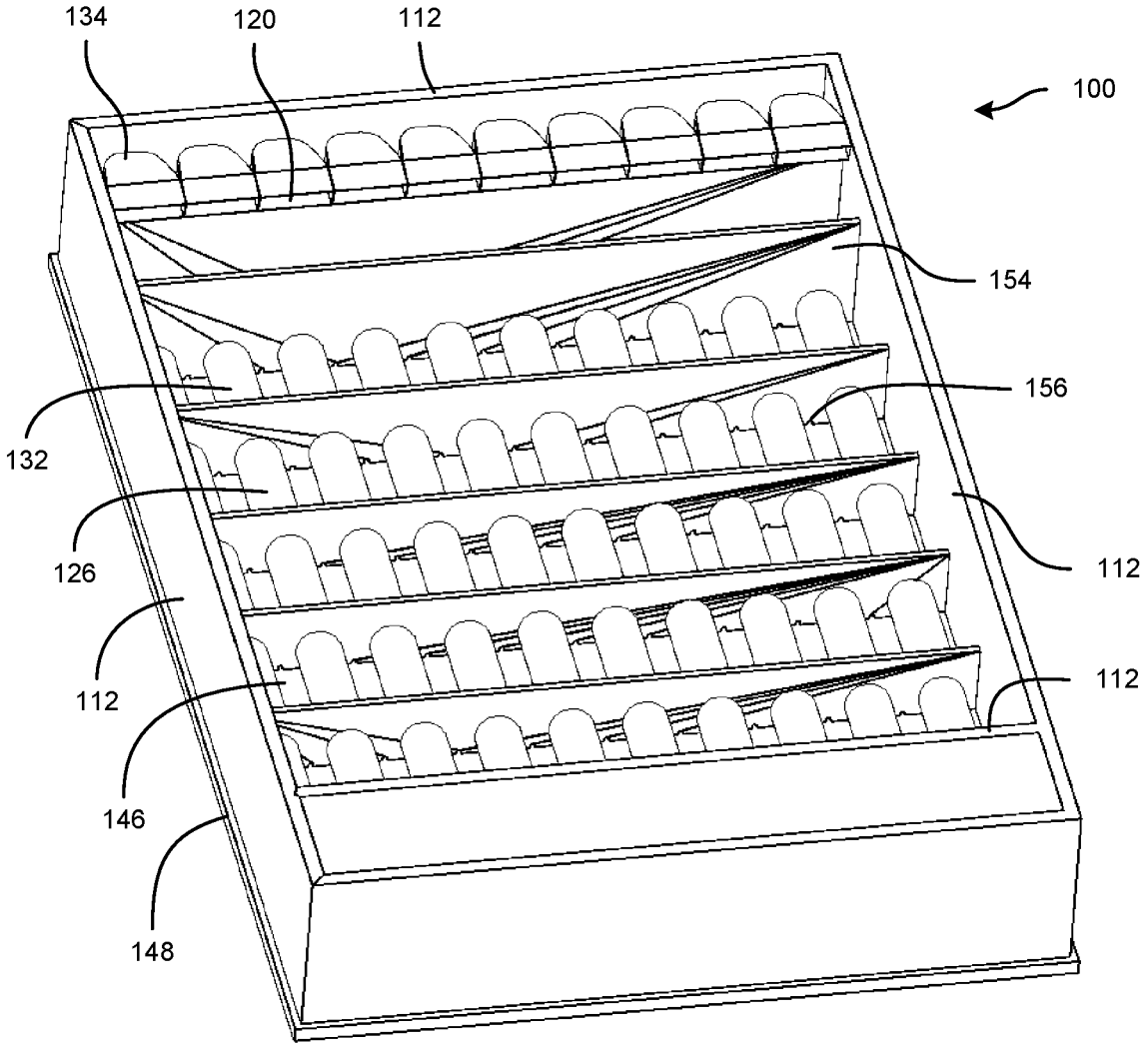
FIG. 14 shows a perspective view of an example embodiment of a system for generating waves with the water channel omitted from view.

The system 100 can include one or more supports 154, which can provide support to the water channel 104, such as to support the base 110 and/or the declined surface 114. FIG. 14 shows a perspective view of an example embodiment of a system 100 for generating waves with the water channel 104 omitted from view to show the supports 154. The supports are also shown in at least FIGS. 8, 9, and 12. The supports 154 can extend between the floor 148 and the water channel 104. The supports 154 can extend through the water storage chamber 146. The supports 154 include walls that extend along a width of the system 100. The supports 154 can include one or more openings for the one or more pipes 126 to pass therethrough. The supports 154 can include one or more openings 156, which can enable storage water to be distributed across the water storage chamber 146. The opening(s) 156 can be positioned at the bottom(s) of the supports 156. The opening(s) 156 can be positioned between the pipes 126. Other types of supports 154 can be used, such as pillars, posts, beams, headers, etc. The supports 154 can be spaced apart by 1 m, 2 m, 3 m, 4 m, 5 m, or any values therebetween, or any ranges bounded therein. The system can be configured to withstand earthquake forces. The supports 154 can distribute the load of the water channel 104 (e.g., and the weight of the water therein) to the floor 148. But the load from the water pressure from the water in the channel 104 can be supported by the channel 104, and can be isolated from the water storage chamber 146. Lower water pressure can be advantageous for preventing or reducing leaks. The water storage chamber 146 can withstand the water pressure of the storage water in the chamber 146, and not the water pressure of the water in the water channel 104 or the water return passageway 124.

Figure 15:
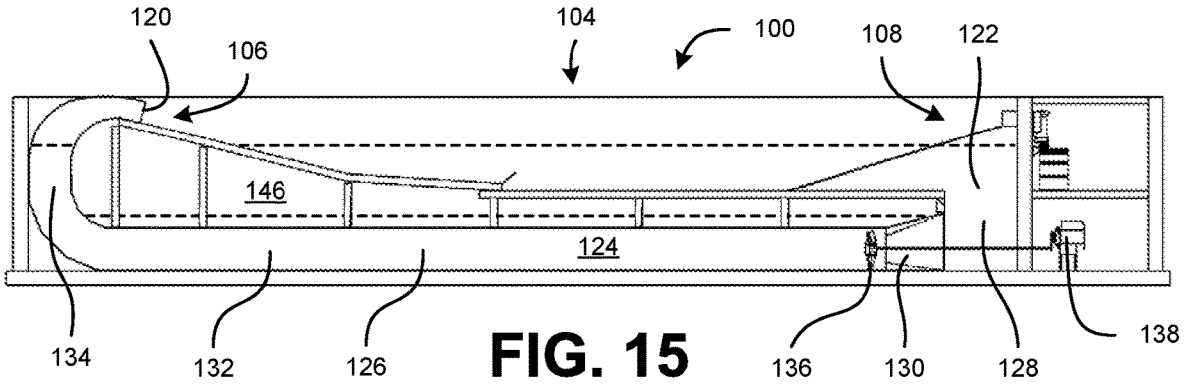
FIGS. 15-18 show the system operating to produce a hydraulic jump.

In some embodiments, the wave generating system 100 can be configured to produce a standing wave using a hydraulic jump. FIGS. 15-18 show the system 100 operating to produce a hydraulic jump. In FIG. 15, the system 100 is shown in an off state. The water in the circulation portion (e.g., the water channel 104 and the water return passageway 124) can form a single continuous body of water. At a resting state, the water level in the water channel 104 can be the same as the water level in the one or more pipes 126. The water level can be lower than the top of the declined surface 114 and/or the nozzle 120, which can produce a break in the water surface. But the single continuous body of water can be coupled through one or more pipes 126. In FIGS. 15-18, the water in the water storage chamber 146 is isolated from the circulation portion. The water level in the water storage chamber 146 does not change as the system 100 is operated in FIGS. 15-18.

Figure 16:
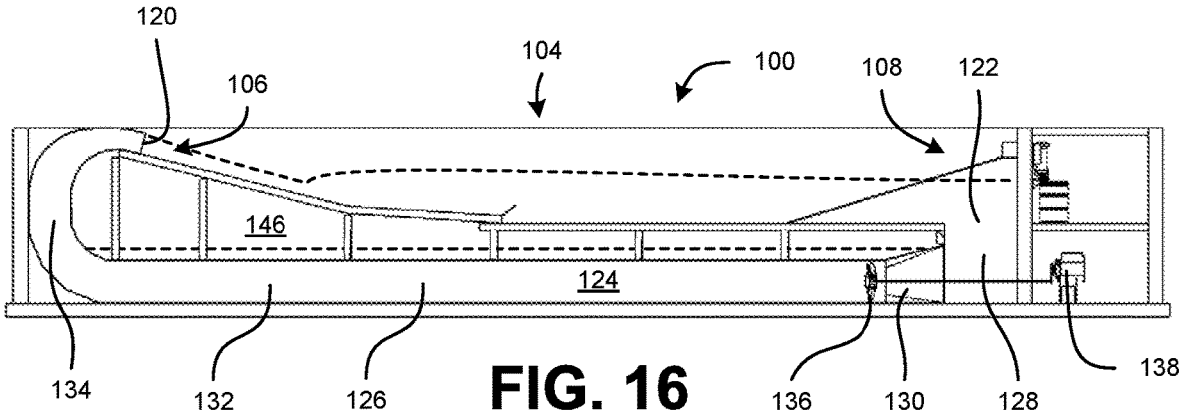

In FIG. 16, the pump can be operated to drive water through the one or more pipes 126 and out the one or more nozzles 120. The water can flow down the declined surface 114, which can cause the velocity of the water flow to increase. The water flowing down the declined surface 114 can reach the relatively inactive water in the water channel, and the flowing water can begin to push the relatively inactive water back (e.g., in the downstream direction).

Figure 17:
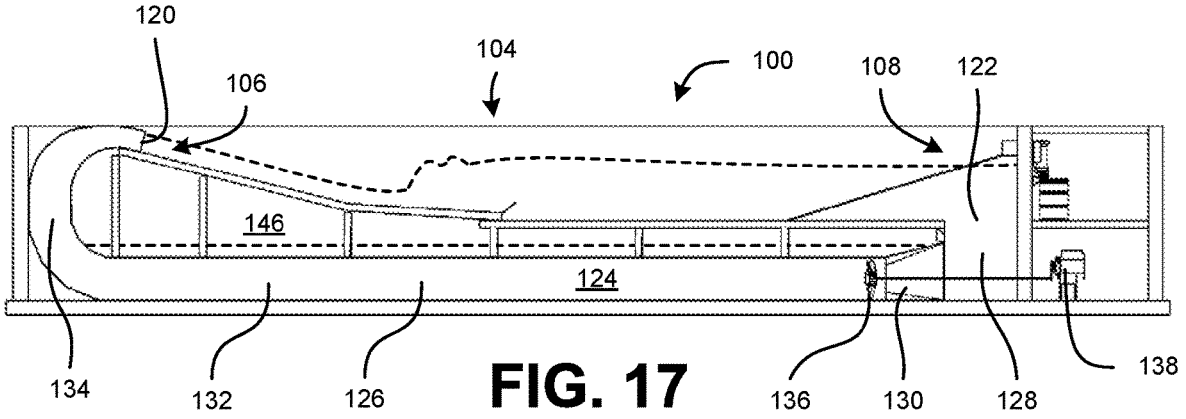
Figure 18:
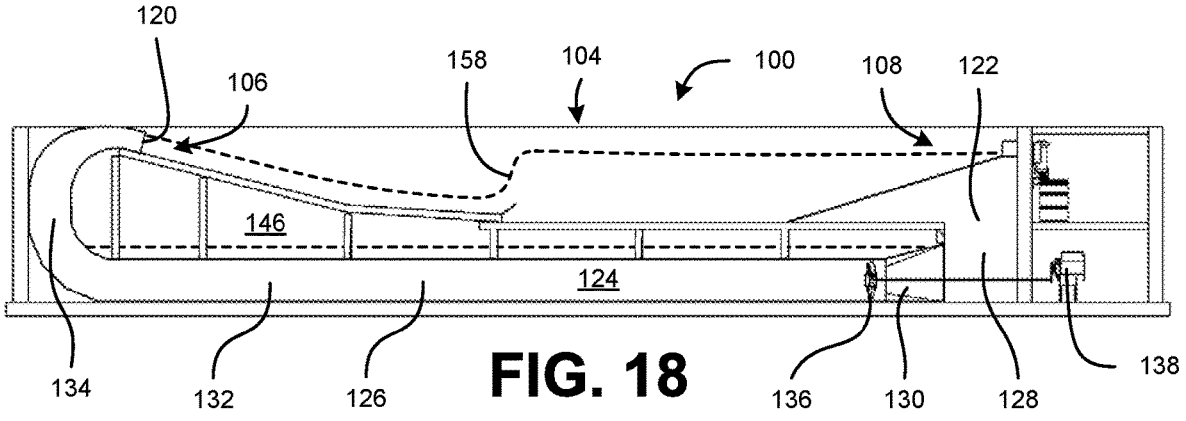

The initial relatively inactive water that is encountered by the flow of water is shallow because of the declined surface 114, and the flow of water can easily push back that shallow water. As the water is pushed back along the declined surface 114, the depth of the water increases, as shown in FIG. 17. Eventually a state of equilibrium is reached, as shown in FIG. 18, where a hydraulic jump 158 produces a standing wave. On a first side (e.g., an upstream side) of the hydraulic jump 158, the water level is relatively low and the water velocity is relatively high. On a second side (e.g., a downstream side) of the hydraulic jump 158, the water level is relatively high and the water velocity is relatively low. The faster flowing water hits the slower moving water and is driven upward to produce the hydraulic jump 158, which can hold back the taller body of water. In some cases, the water level on the second side (e.g., the downstream side) of the hydraulic jump 158 (e.g., as shown in FIG. 18) can be higher than the water level when the system 100 is off (e.g., as shown in FIG. 15). When the system produces a hydraulic jump, the water level downstream of the hydraulic jump 158 can be higher than the water level in the water channel 104 when the water is not flowing (e.g., compare FIG. 15 to FIG. 18).

The system 100 can be configured to generate a standing wave produced by the hydraulic jump 158, where the standing wave has a face that is sufficiently smooth for surfing or other wave riding activities. For example, in some cases a standing wave can be produced that is a turbulent broken wave (e.g., similar to a broken ocean wave), which is generally not desirable for surfing. Parameters, such as the one or more of the pump speed, the water velocity, the water flow rate, the water level in the water channel 104, the height, length, angle, and/or shape of the declined surface 114, the size, shape, position, and/or orientation of the inclined surface 116, can affect the shape and/or size of the resulting standing wave, and can be adjusted to produce a standing wave having a sufficiently smooth face (e.g., similar to an unbroken ocean wave).

The system can direct a pressurized water flow from the one or more nozzles 120 into the water channel 104. The water exiting the one or more nozzles 120 can have a velocity of 2 feet per second, 5 feet per second, 10 feet per second, 15 feet per second, 20 feet per second, 25 feet per second, 30 feet per second, 35 feet per second, 40 feet per second, or any values therebetween, or any ranges bounded therein. In some embodiments, as the water flows down the declined surface 114, the water velocity can increase, such as by 2 feet per second, 4 feet per second, 6 feet per second, 8 feet per second, 10 feet per second, 12 feet per second, 14 feet per second, 16 feet per second, 18 feet per second, 20 feet per second, or any values therebetween, or any ranges bounded therein. Generally, a higher velocity of flowing water is used as the water level in the water channel 104 is raised.

The declined surface 114 can have a first section 114*a* having a first slope and a second section 114*b* having a second slope that is different from the first slope, as can be seen in FIG. 5. The first section 114*a* can be upstream of the second section 114*b*, and the first section 114*a* can be steeper than the second section 114*b*. The first section 114*a* and/or the second section 114*b* can be flat and not curved. The angle of the first section 114*a* relative to horizontal can be 5 degrees, 7 degrees, 10 degrees, 15 degrees, 20 degrees, 25 degrees, 30 degrees, 35 degrees, 40 degrees, or 45 degrees, or any value therebetween, and any ranges bounded by any combination of these values, although other angles could be used in some cases. The angle of the second section 114*b* relative to horizontal can be 1 degree, 2 degrees, 3 degrees, 4 degrees, 5 degrees, 6 degrees, 7 degrees, 8 degrees, 9 degrees, 10 degrees, 12 degrees, 15 degrees, 20 degrees, 25 degrees, 30 degrees, or any value therebetween, and any ranges bounded by any combination of these values, although other angles could be used in some cases.

Figure 19:
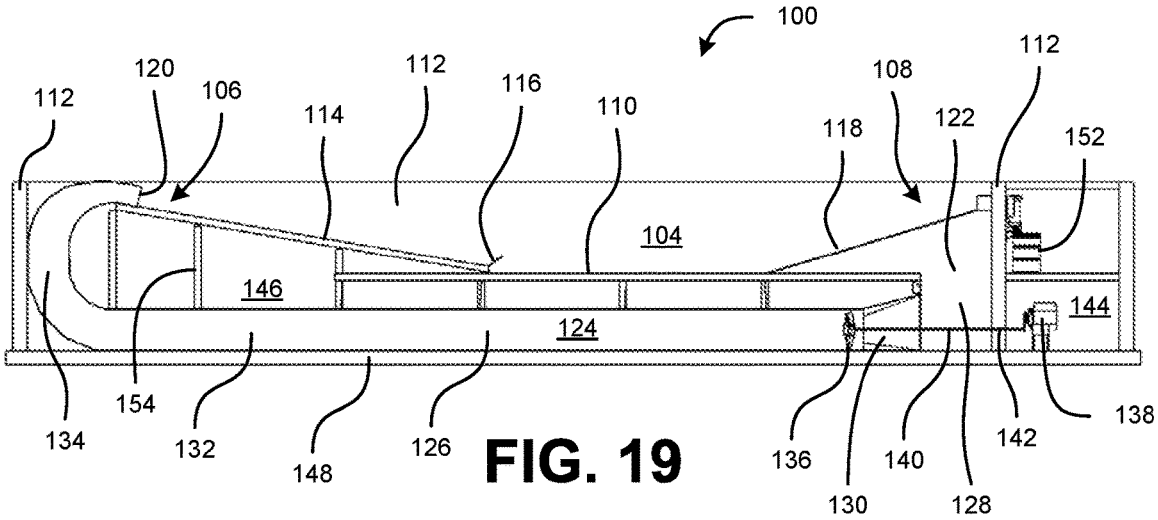
FIG. 19 shows a cross-sectional view of an example embodiment of a wave generating system.

Many variations are possible for the declined surface 114. With reference to FIG. 19, the declined surface 114 can include a single planar section, as opposed to the two sections of different angles. The angle of the declined surface 114 can be 3 degrees, 4 degrees, 5 degrees, 6 degrees, 7 degrees, 8 degrees, 9 degrees, 10 degrees, 12 degrees, 15 degrees, 20 degrees, 25 degrees, 30 degrees, 35 degrees, or any value therebetween, and any ranges bounded by any combination of these values, although other angles could be used in some cases.

Figure 20:
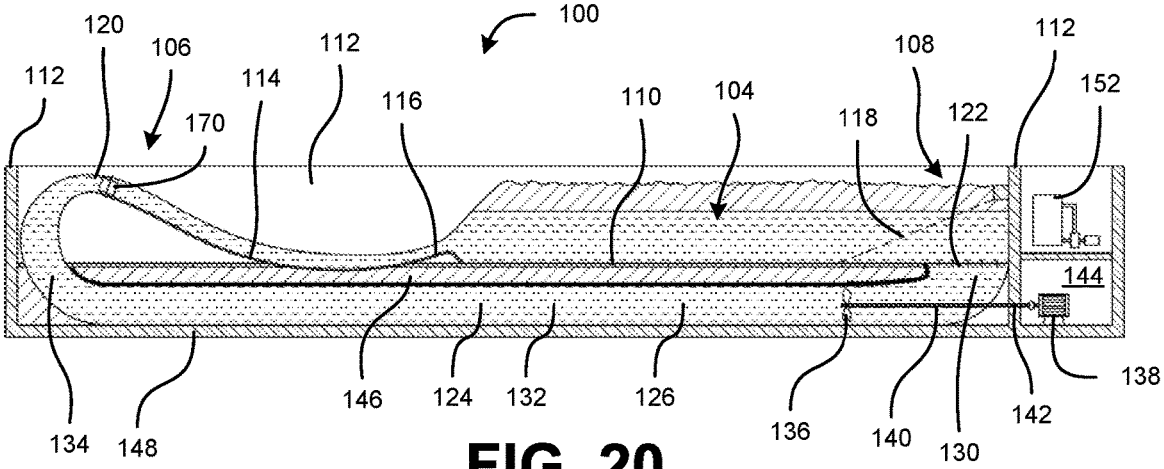
FIG. 20 shows a cross-sectional view of another example embodiment of a wave generating system.

With reference to FIG. 20, in some embodiments, the declined surface 114 can be curved. An upper portion can have a convex curvature and a lower portion can have a concave curvature. In some cases, the curved surface can transition from the declined surface 114 to the inclined surface 116. In some embodiments, there is no flat or horizontal portion between the declined surface 114 and the inclined surface 116. In some embodiments, a continuous curved surface can form the declined surface 114 and the inclined surface 116. In some embodiments, the declined surface 114 can be omitted. For example, water can enter the water channel 104 (e.g., from one or more nozzles 120) at a bottom of the water channel 104. Water can be moved from the water storage chamber 146 to the water channel 104 to increase the water level to the elevated position shown in FIG. 20, which can produce a relatively tall standing wave. Water can be moved from the water channel 104 to the water storage chamber 146 to decrease the water level to the lower position shown in FIG. 20, which can produce a relatively short standing wave, as can be seen in FIG. 20.

Figure 21:
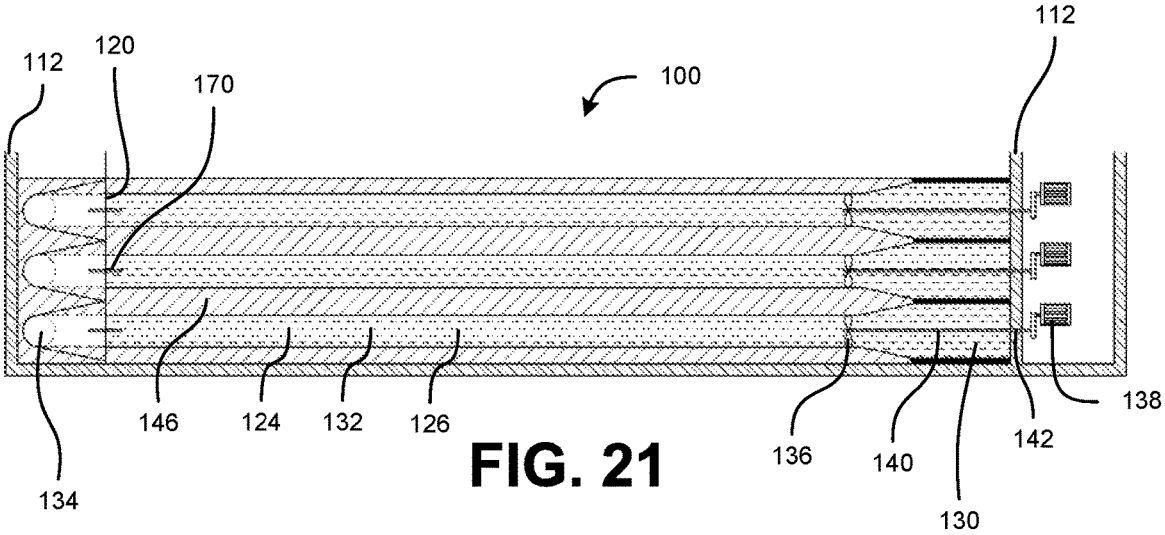
FIG. 21 shows an example embodiment of a wave generating system with the water channel omitted from view.

FIG. 21 is a partial top-down plan view of the example embodiment of a wave generating system 100 of FIG. 20. In the partial view of FIG. 21, three modules are shown, and it will be understood that the system 100 can include additional modules that are omitted from view FIG. 21. In FIG. 21, the water channel is omitted from view. The example embodiment of FIGS. 20-21 can include features similar to those discussed in connection with the other embodiments disclosed herein. In the example embodiment of FIGS. 20-21, the basin 128 can be omitted. The pipes 126 can have intake portions 130 that receive water directly from the outlet 122 of the water channel. The shaft 140 can extend through a side wall of the pipe 126. A seal, which can be similar to seal 142, can enable the shaft 140 to pass through the pipe wall while impeding water from leaking through the pipe wall.

Figure 22:
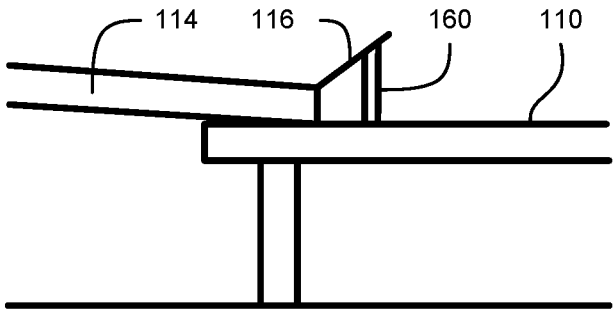
FIGS. 22-25 show example embodiments of wave generating structures that can be used in the water channel of the system.

The inclined surface 116 can improve the shape of the standing wave and/or can increase the size of the standing wave. The standing wave can be generated in the area above the inclined surface 116. Various types of structures can be used for the inclined surface 116. In some embodiments, the inclined surface 116 can be an inclined planar member with open space underneath (e.g., see FIG. 5). In some embodiments, the structure can include the inclined surface 116 on an upstream side and a declined surface on the downstream side (e.g., see FIG. 20). With reference to FIG. 22, in some embodiments, one or more supports 160 can be positioned under the inclined surface 116 (e.g., extending between the base 110 and the inclined surface 116). The one or more supports 160 can be stationary, and the inclined surface 116 can be fixed in place, in some implementations.

Figure 23:
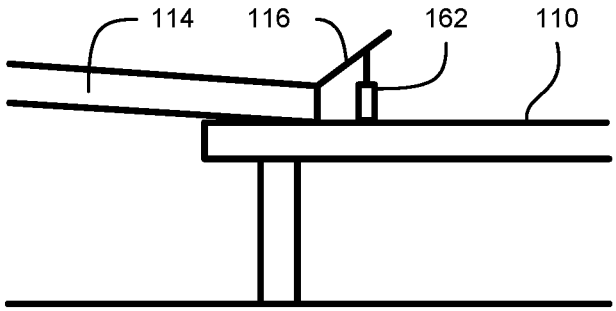
Figure 24:
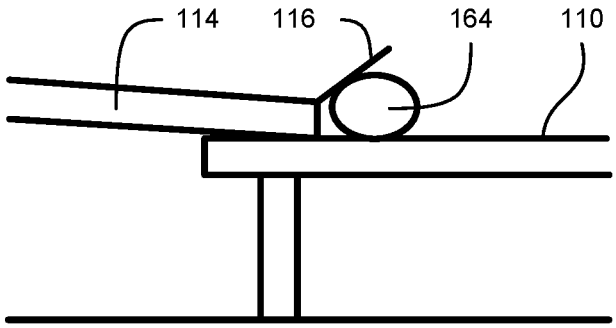

With reference to FIG. 23, in some embodiments, the inclined surface 116 can be movable. One or more actuators 162 can be used to adjust the position or orientation of the inclined surface 116. The one or more actuators 162 can be hydraulic actuators, pneumatic actuators, or any other suitable type of actuator. The one or more actuators 162 can respond to commands received from a control system and/or received from a user interface to move the inclined surface 116. In some cases, the inclined surface 116 is configured to pivot about a pivot axis at the upstream edge of the inclined surface 116. The inclined surface 116 can be positioned at or movable between various different angles relative to the horizontal direction, such as 5 degrees, 10 degrees, 15 degrees, 20 degrees, 30 degrees, 40 degrees, 45 degrees, 50 degrees, 60 degrees, 70 degrees, 80 degrees, 90 degrees, or any values therebetween, and any ranges bounded by any combination of these values, although other angles could be used in some cases. With reference to FIG. 24, in some embodiments, an inflatable bladder 164 can be under the movable inclined surface 116. The actuator can be an inflatable bladder 164, which can be coupled to a fluid (e.g., gas or liquid) source and a pump. Inflating the bladder 164 can cause the inclined surface 116 to rise (e.g., increasing the slope angle of the inclined surface 116). Deflating the bladder 164 can cause the inclined surface 116 to lower (e.g., decreasing the slope angle of the inclined surface 116). In some embodiments, the full width of the inclined surface 116 can move together (e.g., by operating a plurality of actuators 162 in unison). In some cases, the inclined surface 116 can be divided into sections, which can be actuated independently. For example, a first section of the inclined surface 116 can be at a first position (e.g., more elevated) to produce a wave having a first height and/or first shape at a first portion (e.g., right side) of the water channel 104, while a second section of the inclined surface 116 can be at a second position (e.g., less elevated) to produce a wave having a second height and/or second shape at a second portion (e.g., left side) of the water channel 104.

Figure 25:
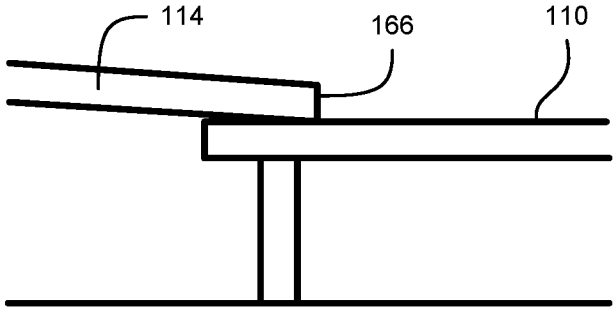

With reference to FIG. 25, in some embodiments, the inclined surface 116 can be omitted. For example, a hydraulic jump 158 can be generated to produce a standing wave without the inclined surface 116. In some embodiments, the junction from the declined surface 114 to the base 110 can have a drop off (e.g., a vertical edge). In some cases, the junction 166 from the declined surface 114 to the base 110 of the water channel 104 can be a smooth transition.

In some embodiments, the flow of water within the system (e.g., wave pool) can represent a continuous hydraulic circuit, for example without drops or other hydraulic breaks that would result in the loss of energy. Hydraulic continuity can be a significant difference from other manmade wave designs, which can result in significantly lower energy requirements for certain embodiments of the system (e.g., wave pool) as compared to other designs.

One key feature of some embodiments of the system (e.g., wave pool) that can provide hydraulic continuity can be that it can comprise only one open water surface in the circuit, occurring within the water channel 104 (e.g., pool) at the highest elevation of the circuit for example. The remainder of the circuit can be closed, pressurized flow that can preserve the pressure head of the flowing water, eliminating the need to provide energy to lift the water from a lower pool into an elevated pool, which is an approach followed by many other manmade wave designs.

In some embodiments, starting at the upstream end of the water channel 104 (e.g., pool), water can enter the water channel 104 at an elevation near the top of the water channel 104 (e.g., pool) and with high velocity. As the water flows down the sloped portion of the water channel 104 (e.g., pool), it can lose elevation but can gain velocity, and the total energy head of the water can remain relatively constant. At the wave, a hydraulic jump can occur in which the elevation and velocity of the water can change, but total energy in the water can be reduced only by the minor turbulence losses in the jump. Downstream of the wave, the water can have less velocity but the water surface may be elevated (e.g., even higher than the inlet elevation, in some cases), so the overall energy of the water can be similar. From the downstream end of the water channel 104 (e.g., pool), water can flow in a closed conduit to return to the upstream end of the water channel 104 (e.g., pool), and the pressure head can be preserved. The only energy loss in the water return passageway 124 (e.g., in the conduit/pipe 126) can be friction loss. Thus, the water can flow in a complete circuit with the only energy losses possibly created by friction, which is generally present in most if not all manmade water designs, and the turbulence of the water (e.g., at the wave itself), and entry losses and exit losses.

The closed system used to convey water through some embodiments of the system (e.g., wave pool) can also allow rapid (e.g., substantially instantaneous) changes in flow rate, for example with changes in propeller speed. This can create the opportunity for dynamically changing wave size and/or water velocity in the water channel 104 (e.g., pool). Other manmade wave designs generally rely on the pumping of water into an elevated pool and gravity flow from the pool over a weir, creating substantial lag time between changes in pumping rate and change in discharge water velocity and/or wave height.

Certain designs for manmade waves typically have the water dropping from an elevated pool upstream of the wave into a lower elevation pool at the downstream end of the water. This can create the need to lift the water with pumps back into the upper pool. The necessary pumps can require more energy and can be much more expensive than the equipment used in certain embodiments of the wave generating system 100 (e.g., wave pool).

With reference to FIG. 18, the water downstream of the hydraulic jump 158 can have a higher water level and a slower water velocity as compared to the water upstream of the hydraulic jump 158. The system 100 can have hydraulic continuity from the elevated water in the water channel 104 downstream of the hydraulic jump 158, through the outlet 122, through the water return passageway 124 (e.g., through the one or more pipes 126), to the one or more nozzles 120. In some embodiments, when a volume of water enters a first end of the water return passageway 124 (e.g., by flowing through the outlet 122 of the water channel 104, a corresponding volume water is forced out of the second end of the water return passageway 124 (e.g., by flowing out of the one or more nozzles 120). The weight of the elevated water downstream of the hydraulic jump 158 can provide force that drives water through the outlet 122 and into the water return passageway 124, which can in turn drive water out of the one or more nozzles 120. The weight of the water in the water channel 104 can provide force that pushes water through the one or more pipes 126. The pressure head of the water in the water channel 104 can be hydraulically coupled to the water in the pipe 126 so as to help lift the water in the pipe 126 up to the nozzle 120. In some embodiments, the water return passageway 124 does not have any water surfaces that are open to air. The system 100 can be configured to have no water surfaces that are open to air in the hydraulic path between the outlet 122 of the water channel 104 and the inlet to the water channel 104 (e.g., the nozzles 120). The system does not drain water out of the water channel 104 and into an open body of water before moving the water to the inlet of the water channel 104, and/or the system does not move water up into an open body of water (e.g., a reservoir) before inputting the water into the water channel 104.

The pump (e.g., propeller 136 and motor 138) can also contribute force to drive the water through the one or more pipes 126. In some embodiments, the pump (e.g., propeller 136 and motor 138) can merely supplement the force to move the water through the one or more pipes 126. The pump can move the water up to the water channel 104 (e.g., to the nozzle 120) using less energy because of the water pressure produce by the water in the water channel 104 (e.g., downstream of the hydraulic jump), which can be hydraulically linked to the water in the pipe 126. For comparison, more pump energy would be used if water from the water channel 104 were to pour into a the basin 128 to make an hydraulically separate body of water (e.g., having an open air surface in the basin 128), because the pump would be lifting the water from the basin 128 up to the water channel 104 (e.g., to the nozzle 120). When the pressure head of the water in the channel 104 contributes, as in the design of FIG. 18, the pump may only need to provide the force to lift water from the height of the water level that provides the pressure head (e.g., the elevated water downstream of the hydraulic jump 158) to the height of the nozzle 120.

The water circulating in the system 100 can produce a hydraulic circuit. When creating a hydraulic jump 158, the water downstream of the hydraulic jump 158 can be elevated and can produce a pressure head. The pressure head can drive water through the outlet 122 and into the water return passageway 124. The pressure head can drive water through the one or more pipes 126 to the one or more nozzles 120. Water can exit the nozzles 120 with velocity and can gain additional velocity as it flows down the declined surface 114. The flowing water can reach the hydraulic jump 158, and the flowing water can be lifted upward (e.g., converting kinetic energy of the flowing water to potential energy), and the potential energy of the lifted water can contribute to the pressure head to circulate additional water through the system. The inclined surface 116 can facilitate the upward motion of the water and the conversion of kinetic energy to potential energy at the hydraulic jump 158. The pump can compensate for energy losses in as the water circulates, such as energy losses from friction as the water flow through the water channel 104 and/or through the water return passageway 124, energy losses from turbulence in the water, and/or entry losses and/or exit losses (e.g., as the water enters/exits the pipes 126 or otherwise changes velocity). The pump can also be used to adjust the flow rate and/or water velocity of the water entering the water channel 104 (e.g., through the corresponding nozzle 120).

Figure 26:
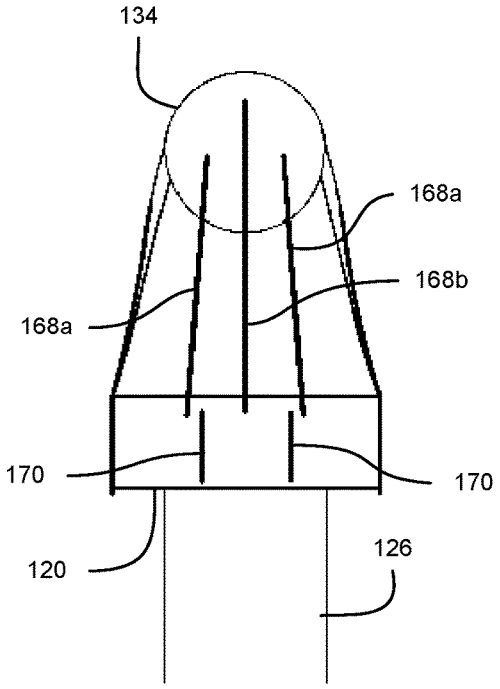
FIG. 26 is a top-down view of the output end of an example embodiment of a pipe, where the top side of the pipe is omitted from view to show the inside of the pipe.
Figure 27:
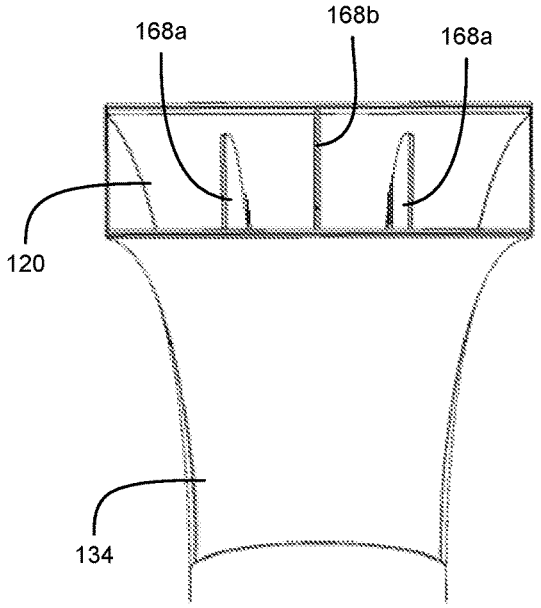
FIG. 27 shows a view of the output end of an example pipe having fins.
Figure 28:
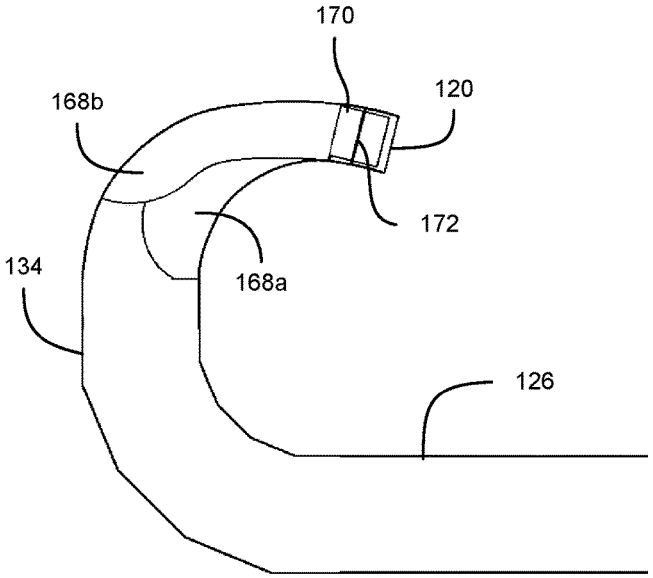
FIG. 28 is a cross-sectional view taken through an example embodiment of a pipe having fins.

In some embodiments, the water return passageway 124 can include features for smoothening the water that is input into the water channel 104 (e.g., from the one or more nozzles 120). For example, one or more fins 168 can be positioned in the one or more pipes 126, which can produce a more laminar flow of water out of the one or more pipes 126. FIG. 26 is a top-down view of the output end of an example embodiment of a pipe 126, which can be used with the wave generating system disclosed herein. In FIG. 26, the top side of the pipe 126 is omitted from view to show the inside of the pipe 126. FIG. 27 shows a view of the output end of an example pipe 126 having fins 168. FIG. 28 is a cross-sectional view taken through an example embodiment of a pipe 126 having fins 168. The fins 168 can extend along at least a portion of the transition portion 134 of the pipe 126. The fins 168 can be substantially vertically oriented. One or more of the fins 168*a* can be attached to the inside of the pipe 126 on a bottom side of the pipe 126. One or more of the fins 168*b* can be attached to the inside of the pipe 126 on a top side of the pipe 126. The one or more fins 168 can extend along a length of the pipe 126 for a distance, which can be 0.2 m, 0.3 m, 0.4 m, 0.5 m, 0.6 m, 0.7 m, 0.8 m, 0.9 m, 1 m, 1.2 m, 1.5 m, 2 m, 3 m, or more, or any values therebetween, or any ranges bounded by any combination of these values, although other values can be used in some instances. The fins 168 can have a height that is less than the width of the pipe 126, such that the fins 168 do not extend fully across the pipe 126 (e.g., see FIG. 30). In some cases, one or more of the fins 168 can extend across a full width of the pipe 126 (e.g., see FIG. 31). In some cases, the height of the fin 168 can increase from an end of the fin 168 furthest from the pipe output to an end of the fin 168 closest to the pipe output.

The one or more fins 168 can divide the flow of water in the pipe 126 to smaller areas, which can help produce a more laminar flow of water out of the pipe 126. In the example embodiments of FIGS. 26-28, the pipe 126 can include three fins 168, although any suitable number of fins 168 can be used. In some cases, the number of fins 168 can depend on the area of the pipe 126 or nozzle 120. The fins 168 can define water flow pathways in the pipe 126 (e.g., through the nozzle 120) to have width of 1 cm, 2 cm, 3 cm, 5 cm, 7 cm, 10 cm, 12 cm, 15 cm, 20 cm, 25 cm, 30 cm, or any values therebetween, or any ranges bounded by any combination of these values, although other values could be used in some cases.

Figure 29:
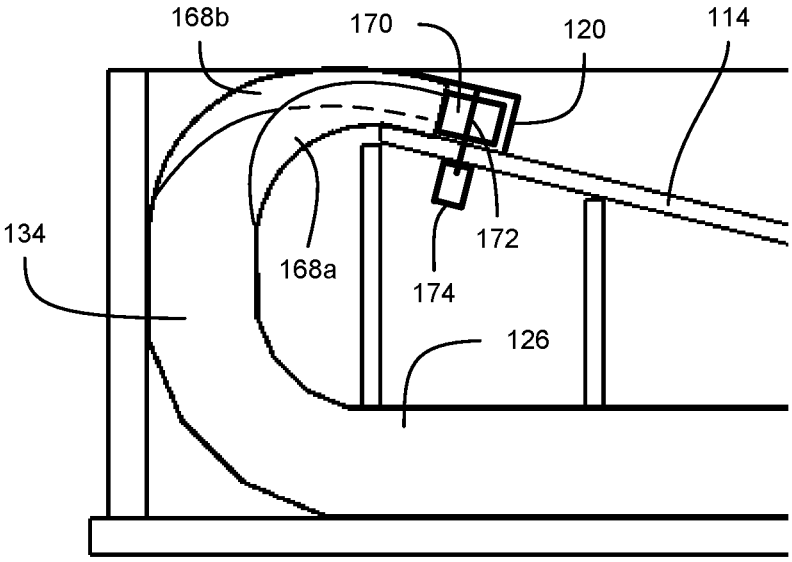
FIG. 29 is a partial cross-sectional view of an example embodiment of a wave generating system that has a pipe with water smoothening fins.

FIG. 29 is a partial cross-sectional view of an example embodiment of a wave generating system 100 that has a pipe 126 with water smoothening fins 168. The fins 168 can extend up to the nozzle 120, or the ends of the fins 168 can be recessed back in the pipe 126. When viewed from the side, the fins 168*a* can at least partially overlap the fins 168*b* (e.g., at an area closer to the pipe output). In some cases, the fins 168*a* and 168*b* do not overlap when viewed from the side (e.g., at an area that is further from the pipe output).

Figure 30:
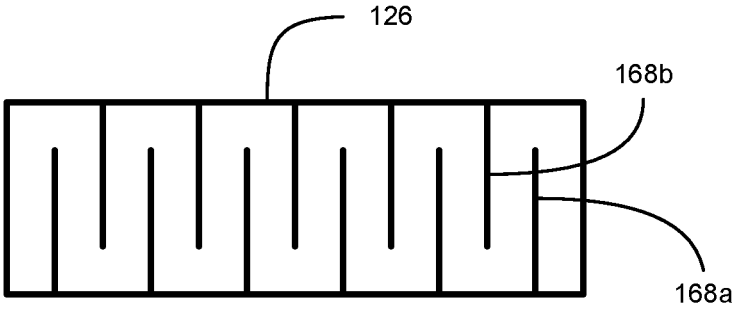
FIG. 30 shows a cross-sectional view taken through the pipe having a plurality of fins.

FIG. 30 shows a cross-sectional view taken through the pipe 126 (e.g., at the nozzle 120) having a plurality of fins 168. The fins 168 can be arranged so that the pipe still contains a single continuous aperture. The aperture can have a shape that weaves back and forth between the fins 168. The fins 168 can alternate between bottom-attached fins 168*a* (e.g., which can be spaced apart from the top side of the pipe) and top-attached fins 168*b* (e.g., with can be spaced apart from the bottom side of the pipe).

Figure 31:
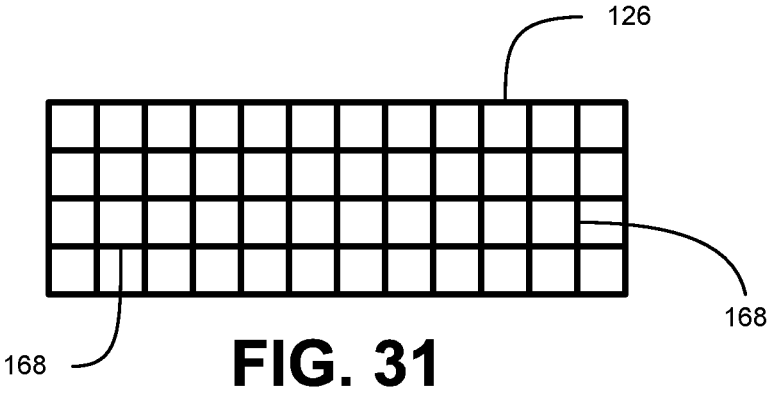
FIG. 31 shows a cross-sectional view taken through the pipe having a plurality of fins.

FIG. 31 shows a cross-sectional view taken through an example pipe 126 with a plurality of fins 168. Some fins can extend generally vertically, and some fins can extend generally horizontally. The fins 168 can be arranged in a grid pattern. Various different shapes and configurations of fins 168 can be used. In some embodiments, the fins 168 can be omitted.

In some embodiments, the system 100 can include one or more water diverters 170, which can divert or redirect water in the water channel 104. In some cases, rudders on the nozzles can be used. In certain embodiments, the inlet nozzles 120 at the upstream end of the water channel 104 (e.g., pool) can be equipped with one or more adjustable rudders to alter the direction of water flow entering the water channel 104 (e.g., pool). The one or more rudders can be remotely controlled and/or programmable in some embodiments, so that a variety of wave shapes can be created. By combining changing rudder positions with changes in propeller speed, a dynamic progression of wave size and/or shape can be created in some embodiments of the system (e.g., wave pool). Other manmade wave designs may not allow flexibility in wave shape. In some embodiments, the water diverters 170 can be omitted.

FIGS. 20 and 21 show example embodiments of a wave generating system 100 that includes water diverters 170. FIGS. 26, 28, and 29 show embodiments that include one or more water diverters 170. The water diverters 170 can be positioned at or near the nozzles 120 that input water into the water channel 104. In some embodiments, the water diverters 170 can be spaced from the nozzles 120, such as on the declined surface 114, or at any suitable position between the nozzles 120 and the inclined surface 116. The water diverters 170 can be generally vertically oriented. The water diverters 170 can pivot about a pivot axis 172, which can be orthogonal to a direction of water flow at the water diverters 170. The pivot axis 172 can extend through a middle of the water diverter 170, or any other suitable location (e.g., at an upstream or downstream end of the water diverter 170). The water diverter 170 can include a flap, planar member, or rudder. The water diverters 170 can be configured to deflect water to the right or to the left.

With reference to FIG. 29, the water diverters 170 can be coupled to one or more actuators 174, which can move the one or more water diverters 170. The actuator 174 can be responsive to commands received from a controller and/or from a user interface to move the water diverter 170 to deflect water in the system 100. In some cases, a shaft can extend through the declined surface 114 to couple the water diverter 170 to the actuator 174. A seal (e.g., similar to the seal 142) can enable the shaft to turn while also impeding water from leaking through the hold for the shaft. In some cases, the water diverters 170 can be moved independently. For example, each water diverter 170 can have an actuator 174. In some cases, multiple water diverters 170 can be linked to move together. For example, the plurality of the water diverters 170 associated with a single module or with a single nozzle 120 (e.g., 2 water diverters in the illustrated example) can be linked to move together, but can be moved independently of other water diverters 170 or groups thereof (e.g., associated with other modules and/or other nozzles 120). In some cases, the water diverters of multiple modules and/or nozzles 120 can be linked to move together. A single actuator 174 can be used to move a group of linked water diverters 170. By way of example, the system can have 20 water diverters, and 10 actuators, 5 actuators, 2 actuators, or 1 actuator. A horizontal shaft can couple the linked water diverters 170, although any suitable linking structure can be used.

With reference to FIG. 26, in some cases multiple water diverters 170 can be associated with a single nozzle 120, a single pipe 126, and/or a single module of the system 100.

In the example embodiment of FIG. 26 two water diverters 170 are disposed in the nozzle 120 at the output end of the pipe 126. Any suitable number of water diverters 170 can be used, such as depending on the size of the nozzles and/or the width of the system. In some cases, adjacent water diverters 170 can be positioned 0.1 m, 0.2 m, 0.3 m, 0.4 m, 0.5 m, 0.6 m, 0.7 m, 0.8 m, 0.9 m, or 1 m apart, or any values therebetween, or any ranges bounded by any combination of these values.

Figure 32:
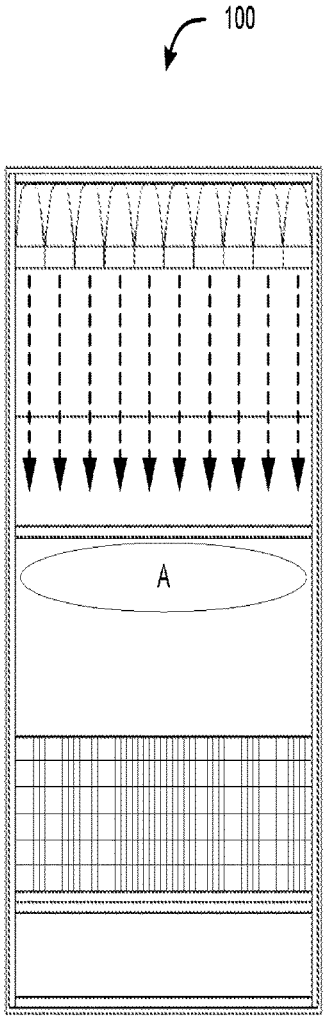
FIGS. 32-37 schematically show example embodiments for operating a wave generating system to produce various types of waves.

Various different wave shapes and/or sizes can be produced by varying one or more of the velocity/flow rate of water entering the water channel 104 (e.g., by varying the pump speed), the direction of water flowing in the water channel 104 (e.g., using the one or more water diverters 170), the water level in the water channel 104 (e.g., using the water transfer system 150), the orientation and/or position of the inclined surface(s) 116 (e.g., using an actuator), etc. FIG. 32 is an example embodiment that schematically shows an example of operating a wave generating system 100 with the water flow from each of the modules at substantially the same flow rates with the water flow straight down the water channel 104, which can produce a wave across the width of the water channel 104 with a generally consistent size and shape (e.g., an unbroken wave that is sufficiently smooth for wave riding activities across substantially the entire face of the wave).

Figure 33:
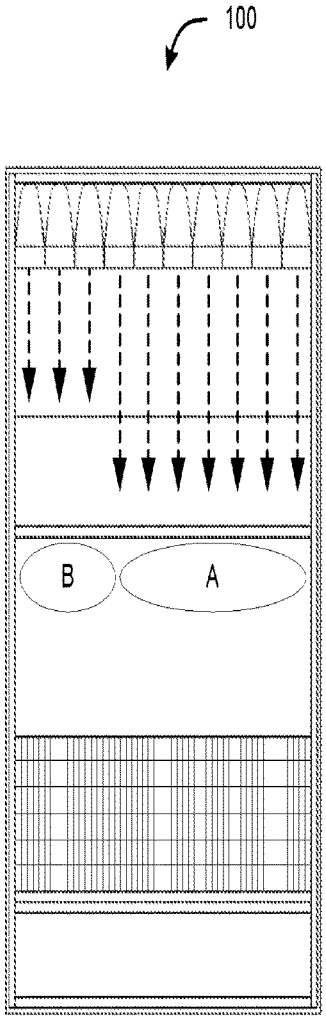

FIG. 33 is an example embodiment that schematically shows an example of operating a wave generating system 100 to produce at least two wave sections (e.g., section A and section B) having different wave types. A first subset of modules can be operated in a first mode, such as having a relatively high flow rate with water directed straight down the water channel 104, which can produce the wave of section A. The wave of section A can be an unbroken wave with a substantially smooth face. A second subset of modules can be operated in a second mode, which as having a lower flow rate with water also directed straight down the water channel 104, which can produce the wave of section B. The wave of section B can be a broken turbulent wave (e.g., similar to a broken ocean wave, only in the form of a standing wave). Generally a wave rider will ride on the substantially smooth face of the wave of section A. A broken wave section B and a substantially smooth face section A can simulate an ocean wave, which can have a broken section and an open face section.

Figure 34:
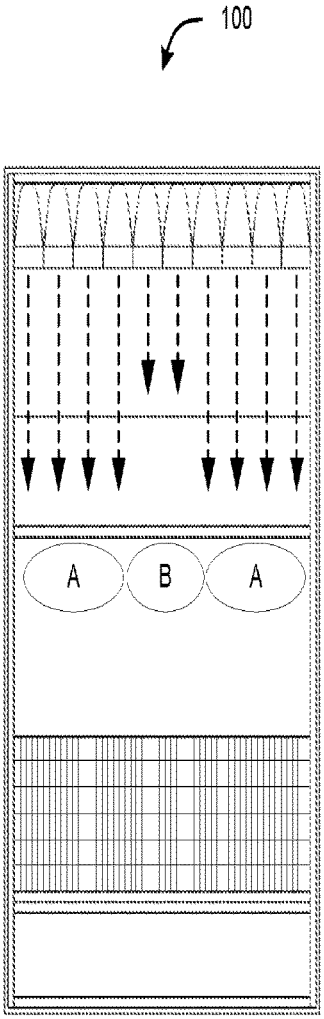

FIG. 34 is an example embodiment that schematically shows an example of operating a wave generating system 100 to produce a broken turbulent wave section B between two open face wave sections A, which can simulate an ocean wave sectioning, which can be facilitate certain types of surfing maneuvers. For example, a surfer can perform an aerial maneuver or floater over the sectioning portion of the wave at section B. Many variations are possible. For example, the flow rate for section B can be increased to be higher than the flow rate at section(s) A, which can produce a different wave shape at section B (e.g., a steeper ramp section B). In some implementations, the broken wave section B can divide the width of the system 100 into different riding zone, so that a first rider can use the right section A while a second rider uses the left section A.

The system 100 can be operated to produce a dynamic wave that changes while a wave rider is riding on the wave. For example, with reference to FIG. 33, the flow rates or other parameters of the modules can be changes in series so that the section B can increase or decrease in width, or so that the section B can move across the width of the water channel 104, or so that section B can be present only intermittently.

Figure 35:
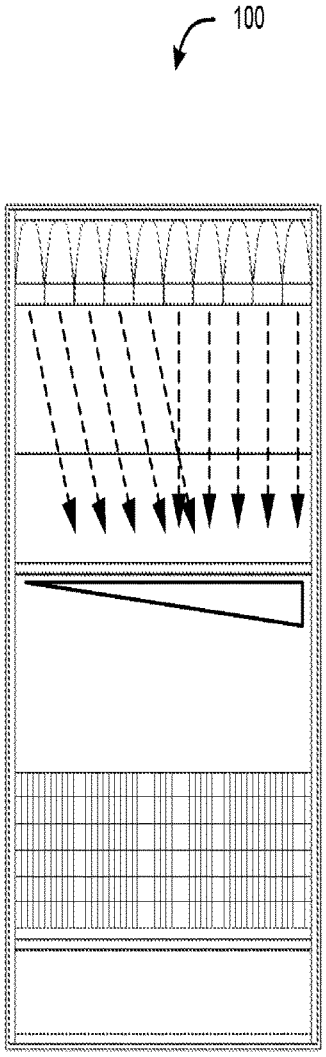

FIG. 35 is an example embodiment that schematically shows an example of operating a wave generating system 100 while using water diverters 170 to deflect water to concentrate water onto a first side of the water channel 104. In FIG. 35, the water diverters 170 on the right half of the system are positioned to divert water towards the left side of the water channel 104, while the modules on the left side are configured to direct the water straight down the water channel 104. This can cause water to concentrate on the left side of the water channel 104. The wave shape and/or height can gradually change across the width of the water channel 104, in some cases. In some embodiments, the angled flow of water can produce a barreling wave or a broken wave (e.g., at the left side of the water channel 104). Many variations are possible. For example, all of the water diverts 170 can direct water towards the left side, or any other suitable number of the water diverters 170.

Figure 36:
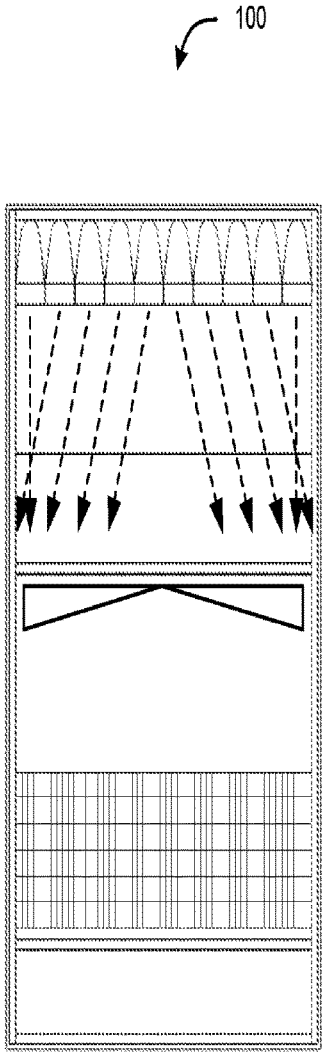

FIG. 36 is an example embodiment that schematically shows an example of operating a wave generating system 100 with some or all of the water diverts on a left side being configured to direct water towards the left side of the channel, while some or all of the water diverters on the right side are configured to direct water towards the right side of the channel. The water can be directed generally away from the center of the water channel 104 to concentrate at the sides of the water channel 104. In some cases, the interaction of the angled flow of water with the side walls can affect the wave shape and/or size.

Figure 37:
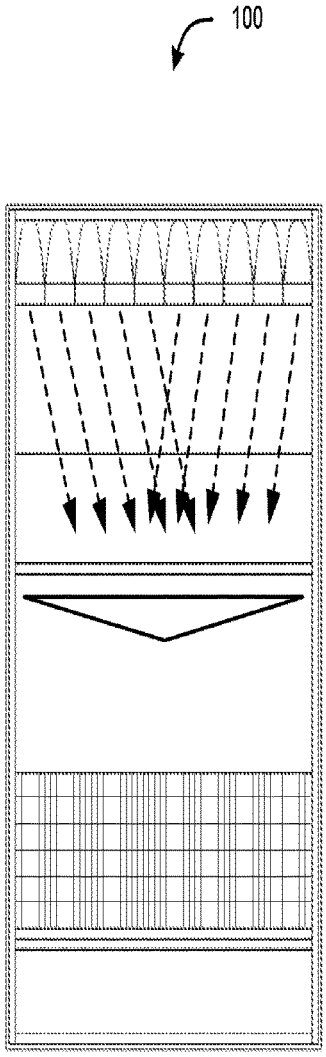

FIG. 37 is an example embodiment that schematically shows an example of operating a wave generating system 100 with some or all of the water diverters on a left side being configured to direct water towards the right side of the channel, while some or all of the water diverters on the right side are configured to direct water towards the left side of the channel. The water can be directed generally towards the center of the water channel 104. In some cases the interaction of the converging water flow can affect the wave shape and/or size. Various different wave types can be produced by varying the parameters discussed herein.

Figure 38:
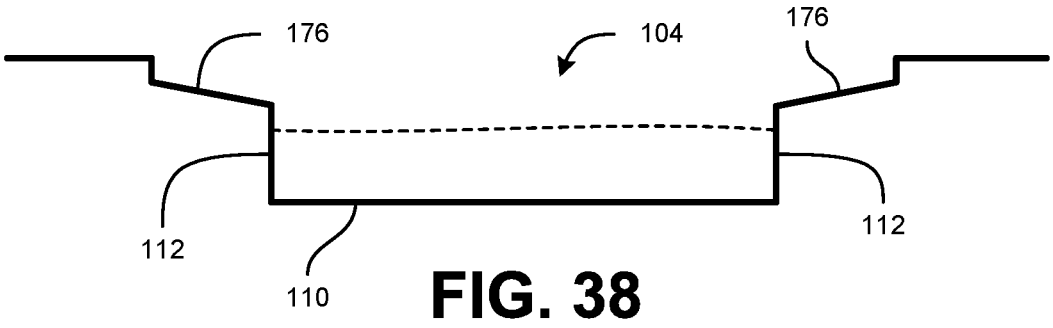
FIG. 38 is a cross-sectional view of a portion of the system including the water channel.
Figure 39:
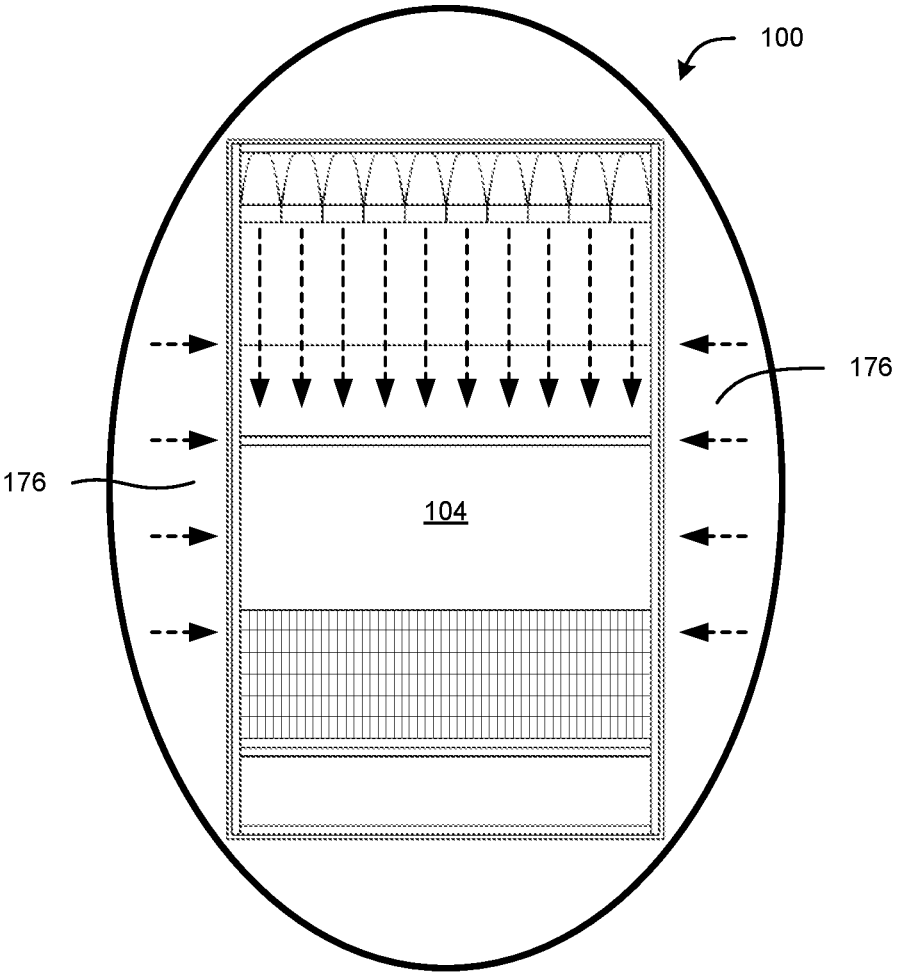
FIG. 39 is a top-down plan view of the system, which can include side portions.

FIG. 38 is a cross-sectional view of a portion of the system 100 including the water channel 104. In some cases, the system 100 can include side areas 176, which can be adjacent to the water channel 104. The side areas 176 can be angled downwards towards the water channel 104, for example so that water on the side areas 176 can drain into the water channel 104 (see FIG. 39). In some cases, the side areas 176 can be used by wave riders to enter and/or exit the water channel 104. FIG. 39 is a top-down plan view of the system 100, which can include side portions 176. The side areas 176 can define a generally elliptical side area portion around the water channel 104, although other shapes can be used for the side area portion (e.g., a rectangular or other polygonal shape). In some cases the side portions at the front and/or back of the water channel 104 can be flat, or they can be angled downward towards the water channel 104 so that water can drain into the water channel 104.

The wave generating system 100 can be recessed into the ground. For example a hole can be made to accommodate some or all of the height of the system 100. In some cases the system can be an above-ground system. A support structure can be built around the wave generating system 100. For example the ground of the surrounding area for people watching the wave rider(s), for pedestrians, for bystanders, etc. can be higher than the floor 148, can be higher than the one or more pipes 126, can be higher than the base 110 of the water channel 104, can be higher than the nozzle 120, can be higher than the top of the water channel, or can be at any location therebetween. The walls 112 can be configured to withstand the water pressure from within the water channel 104 and/or the water storage chamber 146, which can press outwardly on the walls 112. The walls 112 can also withstand the pressure of surrounding earth pressing inwardly on the walls 112 (e.g., in a system that is recessed in the ground). In some cases, the pressure from the surrounding earth and the water pressure of the system can at least partially counter each other. But when the system is empty (e.g., when the water is drained or before water is added to the system), the walls 112 can withstand the surrounding earth pressure without the water pressure to compensate. The base 110 of the water channel 104 can extend (e.g., horizontally) between the side walls 112 and can act at a brace to the walls 112. In some embodiments, the declined surface, can also brace the walls 112. The base 110 can be positioned at a height above the floor 148, and the height can be 0.5 m, 1 m, 1.5 m, 2 m, 2.5 m, 3 m, or any values therebetween, or any ranges bounded therein, although other values can be used.

Figure 40:
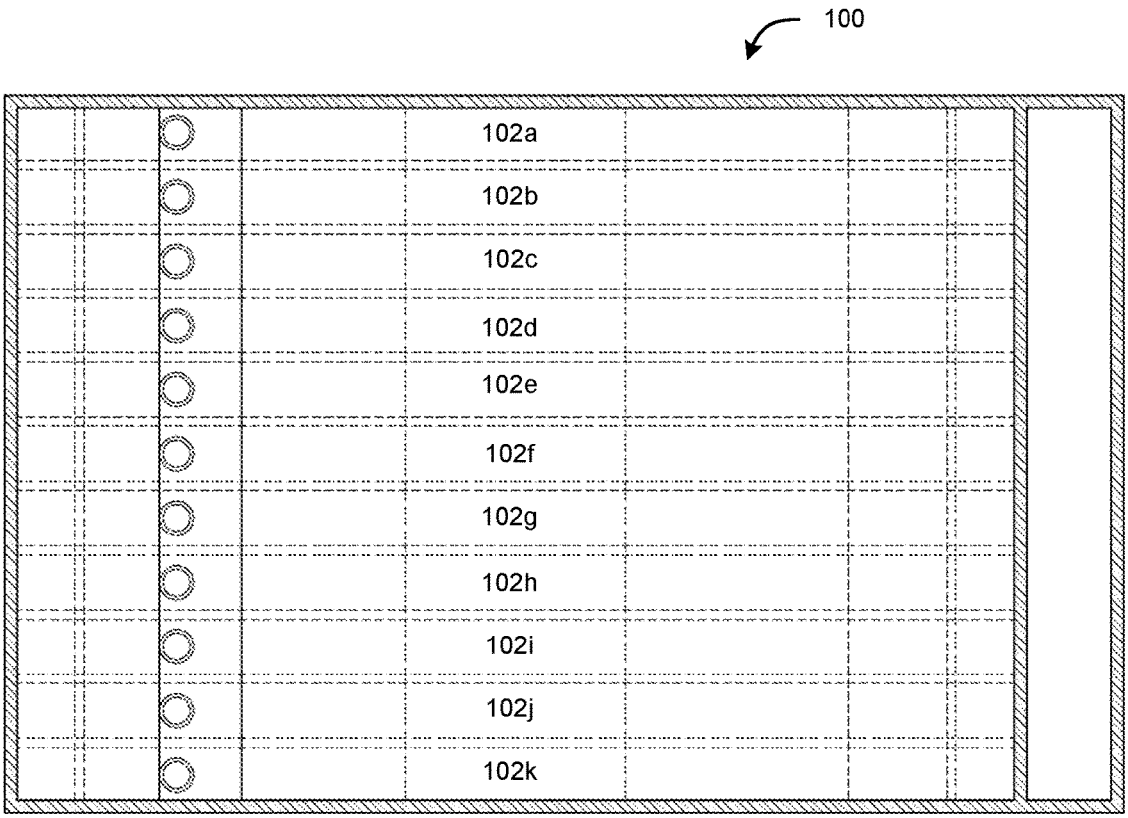
FIG. 40 schematically shows a system for generating waves having modular units.

The system 100 can include modular unit, and the system 100 can be made to have various different widths by varying the number of modular units in the system 100. With reference to FIG. 40, an example embodiment of the system 100 is shown schematically having 11 modular units 102*a*-102*k*. Various different numbers of modular units can be used.

Figure 41:
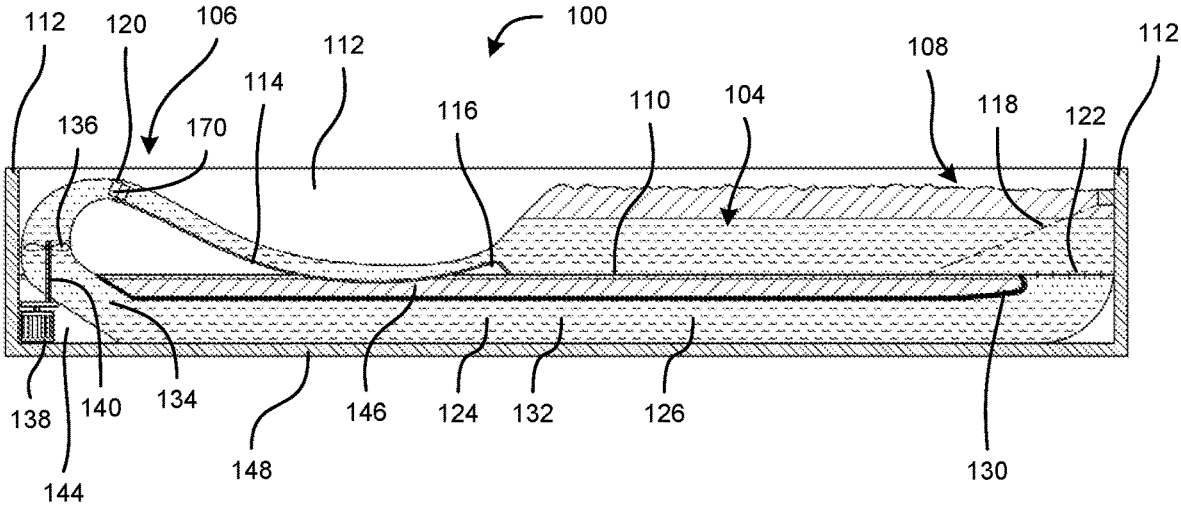
FIG. 41 shows an example embodiment of a wave generating system.

Many variations are possible. For example, with reference to FIG. 41, the pump can be positioned generally at the upstream portion of the system 100. A motor housing area 144 can be located below the transition portion(s) 134 of the pipe(s) 126, and the motor(s) 138 can be located in the motor housing area 144. The motor housing area can be accessible through the side wall 112 at the upstream end of the system 100. The propeller 136 can be located in the transition portion 134 of the pipe 126. A shaft 140 can couple the propeller 136 to the motor 138. The shaft 140 can pass through a hole in the side of the pipe 126, which can have a seal (e.g., similar to the seal 142), which can enable the shaft to spin to drive the propeller 136, while also impeding water from leaking through the hole.

Figure 42:
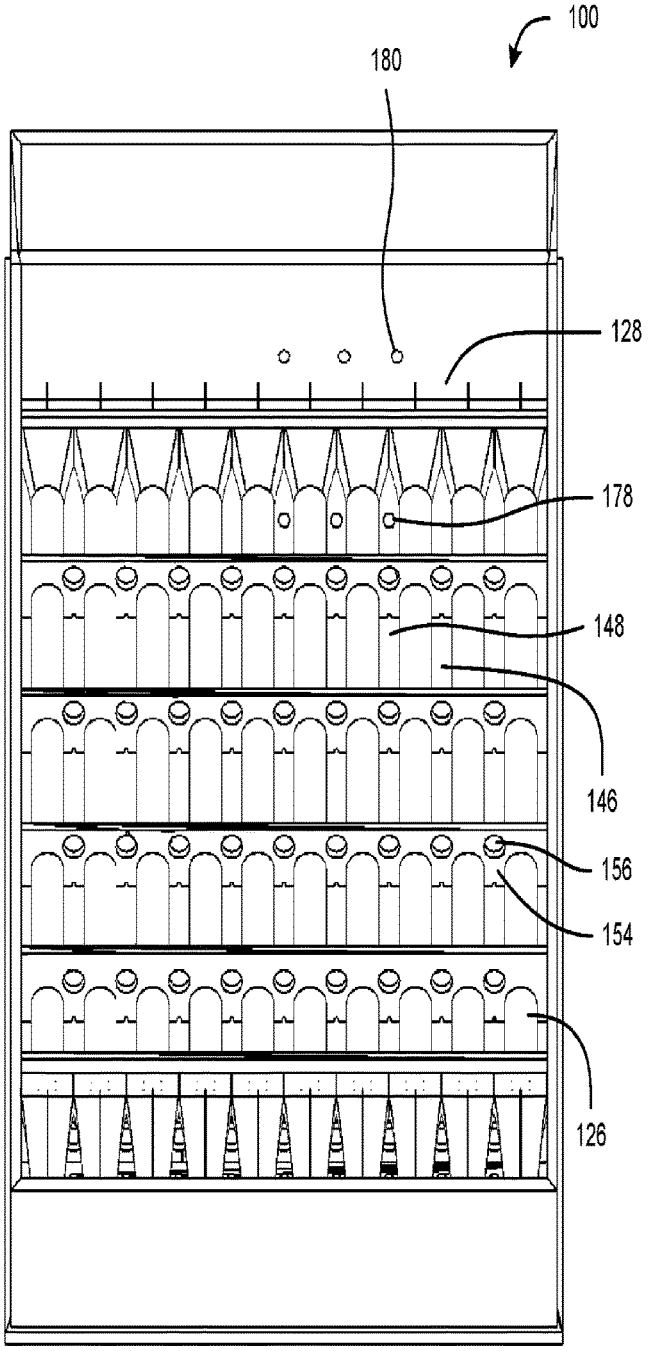
FIG. 42 is a perspective view of an example embodiment of a wave generating system with the water channel omitted from view to show ports for transferring water.
Figure 43:
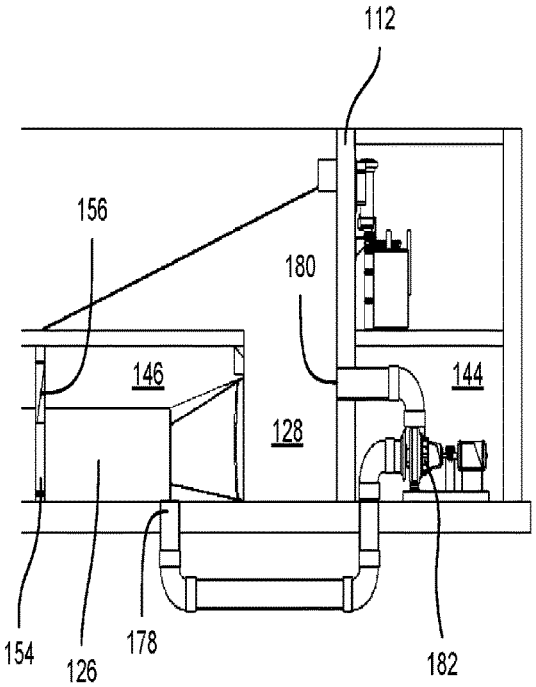
FIG. 43 is a partial cross-sectional view of an example wave generating system having a water treatment system.

With reference to FIGS. 42 and 43, the system 100 can have a fluid transfer system 150, as discussed herein. The fluid transfer system 150 can be configured to move water between the water storage chamber 146 and the water circulating in the water channel 104 and the water return passageway 124. FIG. 42 is a perspective view of the system 100 with the water channel 104 omitted from view. One or more storage water access ports 178 can be located in the water storage chamber 146. One or more circulation water access ports 180 can be located in the back side wall 112, or any other suitable location that can provide access to water that is circulating in the water channel 104 and/or the water return passageway 124. A pump 182 can be coupled fluidically between the storage water access port 178 and the circulation water access port 180, so that the pump 182 can transfer water therebetween. The pump 182 can be located in the motor holding area 144. The storage water access port 178 can be a hole in the floor 148. A pipe can couple the port 178 to the pump 182. The pipe can be located below the floor 148. A pipe can couple the pump 182 to the circulation water access port 180, which can be a hole in the side wall 112. The pump 182 (e.g., in a first mode or forward direction) can transfer water from the water storage chamber 146, through the port 178, through the pipes, through the port 180, and into the basin 128 (or into any other suitable location in the water channel 104 or water return passageway 124). The pump 182 (e.g., in a second mode or reverse direction) can transfer water from the basin 128 (or any other suitable location in the water channel 104 or water return passageway 124) through the port 180, through the pipes, through the port 178 can into the water storage chamber 146. The system 100 can include three ports 178, three ports 180, and three pumps 182, but different numbers of these components can be used.

Figure 44:
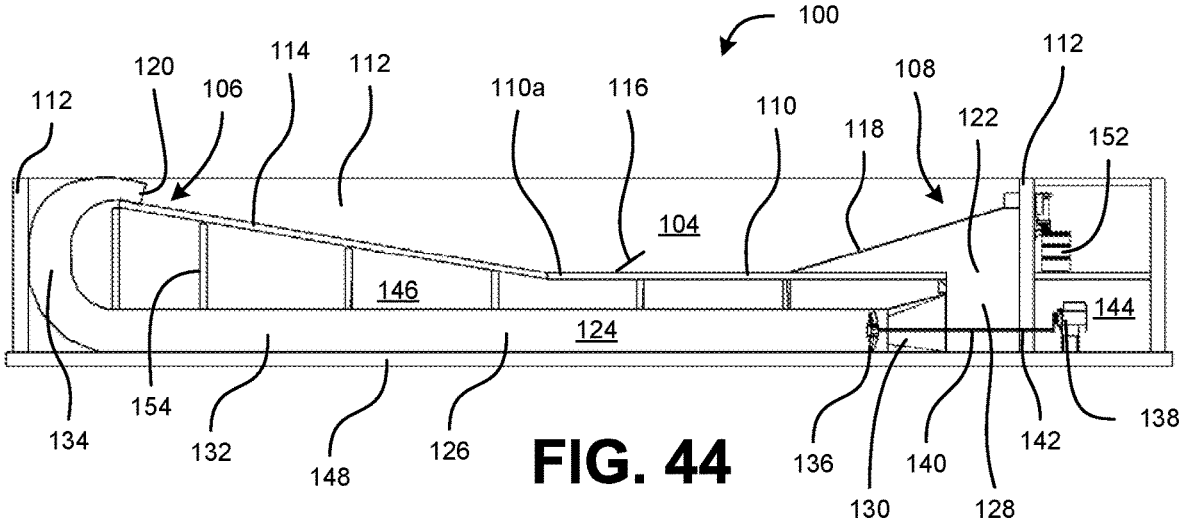
FIG. 44 is a cross-sectional side view of an example embodiment of a wave generating system.
Figure 45:
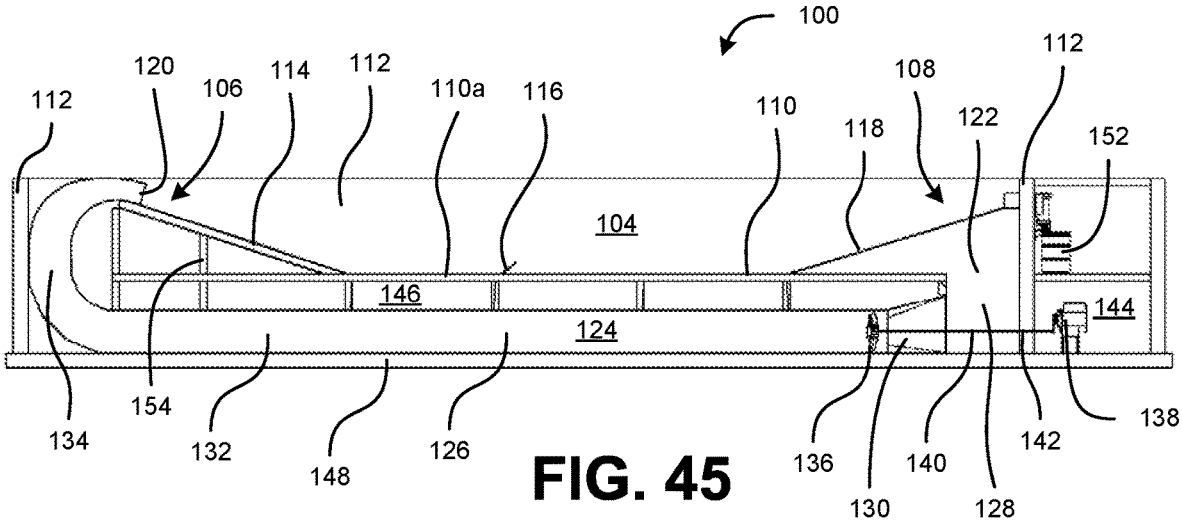
FIG. 45 is a cross-sectional side view of an example embodiment of a wave generating system.

Many alternatives are possible. With reference to FIGS. 44 and 45, in some embodiments, the inclined surface 116 can be spaced downstream from the declined surface 114, such as by 0.2 m, 0.5 m, 1 m, 1.5 m, 2 m, 2.5 m, 3 m, 3.5 m, 4 m, 4.5 m, 5 m, or any values therebetween, or any ranges bounded therein. A section 110*a* of the base 110 can be positioned between the declined surface 114 and the inclined surface 116, as shown in FIG. 45. In some embodiments, the base 110 can extend under the declined surface 114. This can provide beneficial bracing for the walls 112. The base 110 can extend to a location that is directly below the nozzle 120. The base 110 can extend to the front side wall 112, and in some cases can have openings for the one or more pipes 126 (e.g., the transition portions 134 thereof) to pass through the base 110.

Although features has been disclosed in the context of certain embodiments and examples, it will be understood by those skilled in the art that the inventions extend beyond the specifically disclosed embodiments to other alternative embodiments and/or uses and obvious modifications and equivalents thereof. In addition, while several variations of the embodiments have been shown and described in detail, other modifications, which are within the scope, will be readily apparent to those of skill in the art based upon this disclosure. It is also contemplated that various combinations or sub-combinations of the specific features and aspects of the embodiments may be made and still fall within the scope of the disclosure. It should be understood that various features and aspects of the disclosed embodiments can be combined with, or substituted for, one another in order to form varying modes of the embodiments of the disclosed invention. Any methods disclosed herein need not be performed in the order recited. Thus, it is intended that the scope of the inventions herein disclosed should not be limited by the particular embodiments described above.

Conditional language, such as, among others, "can," "could," "might," or "may," unless specifically stated otherwise, or otherwise understood within the context as used, is generally intended to convey that certain embodiments include, while other embodiments do not include, certain features, elements and/or steps. Thus, such conditional language is not generally intended to imply that features, elements and/or steps are in any way required for one or more embodiments or that one or more embodiments necessarily include logic for deciding, with or without user input or prompting, whether these features, elements and/or steps are included or are to be performed in any particular embodiment. The headings used herein are for the convenience of the reader only and are not meant to limit the scope of the inventions or claims.

Further, while the devices, systems, and methods described herein may be susceptible to various modifications and alternative forms, specific examples thereof have been shown in the drawings and are herein described in detail. It should be understood, however, that the inventions are not to be limited to the particular forms or methods disclosed, but, to the contrary, the disclosure is to cover all modifications, equivalents, and alternatives falling within the spirit and scope of the various implementations described. Further, the disclosure herein of any particular feature, aspect, method, property, characteristic, quality, attribute, element, or the like in connection with an implementation or embodiment can be used in all other implementations or embodiments set forth herein.

The ranges disclosed herein also encompass any and all overlap, sub-ranges, and combinations thereof. Language such as "up to," "at least," "greater than," "less than," "between," and the like includes the number recited. Numbers preceded by a term such as "about" or "approximately" include the recited numbers and should be interpreted based on the circumstances (e.g., as accurate as reasonably possible under the circumstances, for example ±5%, ±10%, ±15%, etc.). For example, "about 3.5 mm" includes "3.5 mm." Phrases preceded by a term such as "substantially" include the recited phrase and should be interpreted based on the circumstances (e.g., as much as reasonably possible under the circumstances). For example, "substantially constant" includes "constant." Unless stated otherwise, all measurements are at standard conditions including temperature and pressure.

Unless the context clearly requires otherwise, throughout the description and the claims, the words "comprise," "comprising," "include," "including," and the like are to be construed in an inclusive sense, as opposed to an exclusive or exhaustive sense; that is to say, in the sense of "including, but not limited to." The words "coupled" or connected," as generally used herein, refer to two or more elements that can be either directly connected, or connected by way of one or more intermediate elements. Additionally, the words "herein," "above," "below," and words of similar import, when used in this application, shall refer to this application as a whole and not to any particular portions of this application. Where the context permits, words in the Detailed Description using the singular or plural number can also include the plural or singular number, respectively. The words "or" in reference to a list of two or more items, is intended to cover all of the following interpretations of the word: any of the items in the list, all of the items in the list, and any combination of the items in the list. All numerical values provided herein are intended to include similar values within a range of measurement error.

The following is claimed:

1. A system for generating a standing wave for wave riding activities, the system comprising:

a water channel comprising:

an upstream portion;

a downstream portion;

a channel base; and side walls for containing water flowing from the upstream portion of the water channel to the downstream portion of the water channel;

wherein the water channel is configured to generate a hydraulic jump that produces a standing wave as water flows from the upstream portion of the water channel towards the downstream portion of the water channel, and wherein a water level downstream of the hydraulic jump is higher than a water level upstream of the hydraulic jump;

a water return passageway comprising:

a first end at the downstream portion of the water channel;

a second end at the upstream portion of the water channel; and a plurality of pipes that extend under the water channel, wherein the water return passageway is configured to provide closed hydraulic continuity so that weight of the water downstream of the hydraulic jump provides force that urges water through the plurality of pipes to facilitate delivery of the water to the upstream portion of the water channel;

a plurality of pumps proximate to the downstream portion of the water channel configured to pump water through the plurality of pipes to compensate for energy losses due to friction and water turbulence as the water circulates through the water channel and the water return passageway and to control the speed of water flowing into the upstream portion of the water channel;

a water storage chamber below the water channel, wherein the plurality of pipes extend through the water storage chamber, wherein water is stored in the water storage chamber in space between the plurality of pipes, and wherein the water in the water storage chamber is isolated from the water circulating through the water channel and the water return pathway; and a water transfer system configured to transfer water between the water storage chamber and the water circulating through the water channel and the water return pathway to control a water height in the water channel.

2. A method of producing a standing wave for wave riding activities using the system of claim 1, the method comprising:

directing water into the water channel at the upstream portion of the water channel to produce a flow of water from the upstream portion of the water channel to the downstream portion of the water channel;

generating the hydraulic jump in the water channel that produces the standing wave as water flows from the upstream portion of the water channel towards the downstream portion of the water channel, wherein a water level of the water channel upstream of the hydraulic jump is at a first height and a water level of the water channel from the hydraulic jump downstream to an outlet of the water channel is at a second height that is higher than the first height; and propelling water through one or more pipes of the water return passageway under the water channel to the upstream portion of the water channel, wherein weight of the water downstream of the hydraulic jump provides force that urges water through the water return passageway.

* * * * *